US009734841B2

(12) United States Patent
Yamabe et al.

(10) Patent No.: US 9,734,841 B2
(45) Date of Patent: Aug. 15, 2017

(54) DEVICE AND METHOD FOR SUPPRESSING NOISE SIGNAL, DEVICE AND METHOD FOR DETECTING SPECIAL SIGNAL, AND DEVICE AND METHOD FOR DETECTING NOTIFICATION SOUND

(71) Applicant: JVC KENWOOD Corporation, Yokohama-shi (JP)

(72) Inventors: Takaaki Yamabe, Yokosuka (JP); Toshiaki Nagai, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 275 days.

(21) Appl. No.: 14/300,005

(22) Filed: Jun. 9, 2014

(65) Prior Publication Data

US 2014/0350927 A1 Nov. 27, 2014

Related U.S. Application Data

(63) Continuation of application No. PCT/JP2013/050469, filed on Jan. 11, 2013.

(30) Foreign Application Priority Data

Feb. 20, 2012 (JP) ..... 2012-034190
Feb. 20, 2012 (JP) ..... 2012-034191

(51) Int. Cl.
*G10L 21/02* (2013.01)
*G10L 21/0232* (2013.01)
(Continued)

(52) U.S. Cl.
CPC ..... *G10L 21/0232* (2013.01); *G10L 25/48* (2013.01); *G10L 25/84* (2013.01);
(Continued)

(58) Field of Classification Search
CPC . G10L 2021/02085; G10L 2021/02087; G10L 21/0216
(Continued)

(56) References Cited

U.S. PATENT DOCUMENTS 6,023,658 A * 2/2000 Jeffryes ..... E21B 47/18 702/16
6,745,133 B2 * 6/2004 Axelsson ..... H01J 49/0036 702/27
(Continued)

FOREIGN PATENT DOCUMENTS

JP 4-238399 A 8/1992
JP 2002-258899 A 9/2002
(Continued)

OTHER PUBLICATIONS

International Search Report in PCT International Application No. PCT/JP2013/050469, dated Apr. 16, 2013.

*Primary Examiner* — Jialong He
(74) *Attorney, Agent, or Firm* — Venable LLP; Michael A. Sartori; Laura G. Remus

(57) ABSTRACT

Provided is a noise signal suppressing device including: an input unit configured to receive a sound signal; a time/frequency converting unit; an independent peak spectrum extracting unit configured to extract a peak spectrum having independence; a persistence determining unit configured to determine that the peak spectrum having independence persists for a predetermined period or longer; a noise-signal suppressing unit configured to suppress the peak spectrum having independence as the noise signal. The independent peak spectrum extracting unit includes: a first peak extracting unit configured to extract a peak spectrum having higher energy than that of an adjacent frequency signal, and a second peak extracting unit configured to extract a peak spectrum maintaining a frequency interval of equal to or
(Continued)

larger than a predetermined value with respect to a peak spectrum adjacent thereto as the peak spectrum having independence.

11 Claims, 26 Drawing Sheets

(51) Int. Cl.
*G10L 25/48* (2013.01)
*G10L 25/84* (2013.01)
*G10L 21/0216* (2013.01)
*G10L 21/0208* (2013.01)

(52) U.S. Cl.
CPC ..... *G10L 2021/02085* (2013.01); *G10L 2021/02163* (2013.01)

(58) Field of Classification Search
USPC ..... 704/233, 226
See application file for complete search history.

(56) References Cited

U.S. PATENT DOCUMENTS 7,639,147 B2 12/2009 Berezowski et al.
2002/0128830 A1* 9/2002 Kanazawa ..... G10L 21/0208 704/226
2006/0265215 A1* 11/2006 Hetherington ..... G10L 21/0208 704/226
2007/0174052 A1* 7/2007 Manjunath ..... G10L 19/18 704/219
2008/0069364 A1 3/2008 Itou et al.
2008/0077403 A1 3/2008 Hayakawa
2008/0167870 A1* 7/2008 Hetherington ..... G10L 21/02 704/233
2009/0177466 A1* 7/2009 Rui ..... G10L 21/0208 704/225
2010/0161324 A1* 6/2010 Tanaka ..... G10K 11/178 704/226
2011/0123044 A1* 5/2011 Hetherington ..... G10L 21/0208 381/94.2
2012/0136655 A1* 5/2012 Yamabe ..... G10L 25/90 704/207
2012/0158401 A1* 6/2012 Mazurenko ..... G10L 25/81 704/208
2012/0239394 A1* 9/2012 Matsumoto ..... G10L 25/84 704/233
2013/0043886 A1* 2/2013 Mase ..... A61B 5/021 324/642

FOREIGN PATENT DOCUMENTS

JP 2005-077875 A 3/2005
JP 2008-076676 A 4/2008
JP 2008-076881 A 4/2008

* cited by examiner

FREQUENCY DISTRIBUTION CHART OF SIREN SOUND IN CERTAIN DURATION

FREQUENCY DISTRIBUTION CHART OF SIREN SOUND COLLECTED SIMULTANEOUSLY WITH SPEECH IN CERTAIN DURATION

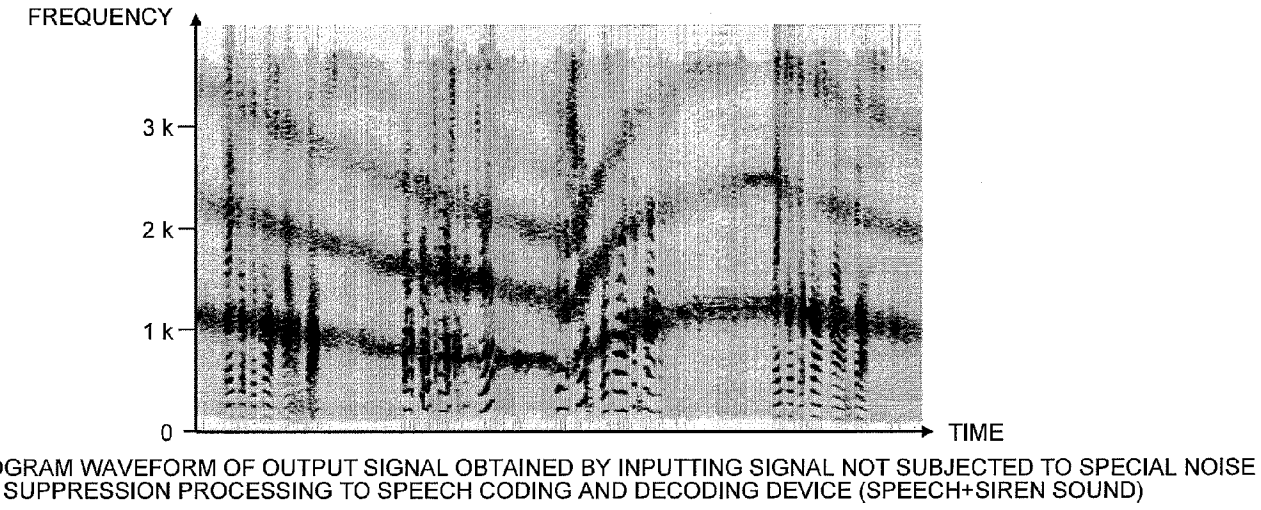

SPECTROGRAM WAVEFORM OF OUTPUT SIGNAL OBTAINED BY INPUTTING SIGNAL NOT SUBJECTED TO SPECIAL NOISE SUPPRESSION PROCESSING TO SPEECH CODING AND DECODING DEVICE (SPEECH+SIREN SOUND)

FIG.18A

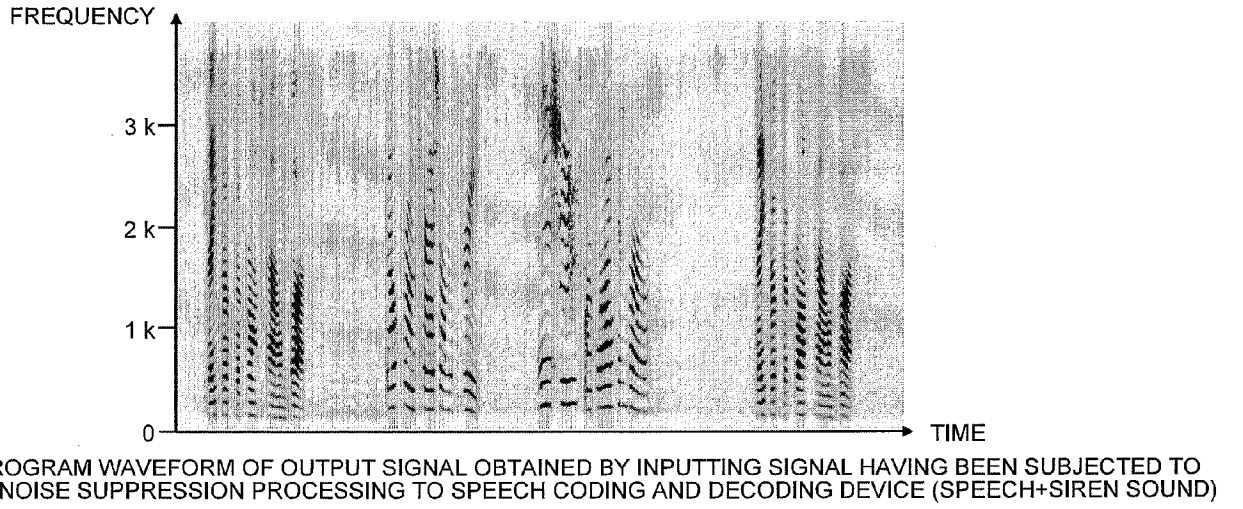

SPECTROGRAM WAVEFORM OF OUTPUT SIGNAL OBTAINED BY INPUTTING SIGNAL HAVING BEEN SUBJECTED TO SPECIAL NOISE SUPPRESSION PROCESSING TO SPEECH CODING AND DECODING DEVICE (SPEECH+SIREN SOUND)

FIG.18B

SPECTROGRAM WAVEFORM OF NOTIFICATION SOUND

DEVICE AND METHOD FOR SUPPRESSING NOISE SIGNAL, DEVICE AND METHOD FOR DETECTING SPECIAL SIGNAL, AND DEVICE AND METHOD FOR DETECTING NOTIFICATION SOUND

CROSS-REFERENCE TO RELATED APPLICATIONS

This application is a continuation of International Application No. PCT/JP2013/050469 filed on Jan. 11, 2013 which claims the benefit of priority of the prior Japanese Patent Application No. 2012-034190 filed on Feb. 20, 2012 and Japanese Patent Application No. 2012-034191 filed on Feb. 20, 2012, the entire contents of which are incorporated herein by reference.

BACKGROUND OF THE INVENTION

1. Field of the Invention

The present invention relates to a device and a method for suppressing a noise signal, a device and a method for detecting a special signal, and a device and a method for detecting a notification sound.

2. Description of the Related Art

Methods for suppressing noise signals are widely used in the fields of speech recognition and mobile communications. In the field of speech recognition, noise-signal suppression processing is performed prior to speech recognition processing, thereby suppressing unnecessary noise other than speech signals and improving the accuracy of speech recognition. In the field of mobile communications, noise-signal suppression processing is performed prior to voice coding to prevent the articulation of speech from deteriorating significantly due to mixture of noise into the voice coding at a low bit rate.

Examples of typical noise reduction methods using noise spectrum detection technologies include a spectrum subtraction method. The spectrum subtraction method estimates a noise spectrum and subtracts a noise component from an input signal including noise, thereby reducing the noise.

The spectrum subtraction method recognizes signals having stationary energy, such as white noise and air conditioners, as noise with relative ease, and has a high noise suppression effect. By contrast, the method has difficulty in classifying a signal, which is closer to a tone signal (a sine wave signal) with a high energy component such as a warning sound including a siren sound or a high-pitched engine sound, as a noise signal. These special sounds have frequency components forming a harmonic structure which is a characteristic of speech, and are extremely similar to components of human speech. This makes it difficult to estimate a noise spectrum of the special sounds.

In an analysis of such a noise spectrum of a siren sound, an engine sound, or the like in a short time period (several tens of milliseconds to several hundreds of milliseconds), a harmonic structure having a fundamental frequency and harmonics, which is a characteristic of a speech spectrum, is clearly observed. Because it is difficult to distinguish a noise spectrum from a speech spectrum, a special analysis method is required.

The duration of the analysis described above is substantially equal to the duration of processing of a typical amount of speech signals accumulated in hardware and of various types of signal processing, such as voice coding. The duration of the analysis is appropriate for the duration of a frequency analysis in a field that requires real time processing. To apply the method to a device used for mobile communications that allow only extremely short delay in signal processing, the analysis of a speech signal needs to be finished within the duration of processing described above.

Japanese Patent Application Laid-open No. 2002-258899 discloses a device for suppressing noise that compares a variation period of a frequency spectrum and spectral intensity of noise with a preset pattern, thereby detecting a special noise signal (e.g., a warning sound) serving as a target so as to suppress the noise signal. In the case of a frequency signal being a long periodic signal such as a siren sound whose frequency signal varies with time, the device for suppressing noise extracts a fundamental frequency by a frequency analysis and compares the extracted fundamental frequency information with frequency shift information (a temporal locus of the fundamental frequency) that varies with time, thereby detecting and suppressing a noise signal such as a siren sound.

Japanese Patent Application Laid-open No. 2005-77875 discloses an alarm sound source recognition device that carries out a frequency spectrum analysis of noise, extracts a peak frequency having the maximum value, and determines, when the sharpness of the peak frequency satisfies a predetermined condition, a noise signal serving as a target as an alarm sound. Based on the characteristics of an artificial siren sound and alarm sound that the energy is concentrated in an extremely narrow bandwidth, the alarm sound source recognition device obtains the sharpness of the peak frequency having the maximum value based on an energy ratio with a frequency band adjacent thereto. Thus, the alarm sound source recognition device detects a noise signal such as a siren sound.

U.S. Pat. No. 7,639,147 discloses a detecting device that detects an alarm sound output from a personal alert safety system (PASS). The detecting device analyzes whether the difference between the maximum sound pressure level of collected audio and the minimum sound pressure level thereof exceeds a predetermined reference value. The detecting device further carries out a frequency analysis and a beat pattern analysis in a time domain on the audio, thereby determining whether or not the audio is an alarm sound specific to the PASS. The detecting method is supposed to be able to detect the alarm sound reliably (refer to FIG. 4, FIG. 5, and the description thereof).

The device for suppressing noise disclosed in Japanese Patent Application Laid-open No. 2002-258899 carries out a pattern analysis to detect a warning sound. Because a certain period of time (several seconds) is required to determine the periodicity in a long term, delay occurs until a noise signal is to be suppressed. In addition, the pattern analysis increases the signal processing load.

The detecting method using a pattern analysis basically detects no signal other than a signal registered for the pattern analysis. In the case of a speech signal overlapping with a warning sound signal, the component of the speech signal is likely to be suppressed, resulting in deteriorated articulation of the speech signal.

The alarm sound source recognition device disclosed in Japanese Patent Application Laid-open No. 2005-77875 employs no pattern analysis, thereby placing no restrictions on a detectable alarm sound. Determination of an alarm sound, however, requires extremely sharp energy peak characteristics in a frequency domain. In a relatively quiet environment and an environment with no sound source at a high sound pressure level other than the alarm sound, the sharp energy peak characteristics can be detected with relative ease.

If noise other than an alarm sound is mixed, however, the peak characteristics are blunted by an influence of the noise component. Because the frequency analysis is usually carried out in duration from several tens of milliseconds to several hundreds of milliseconds, characteristics in an extremely short time are detected. As a result, a noise signal that is not related to an alarm sound may possibly have instantaneously sharp peak characteristics. A speech signal particularly has instantaneously sharp peak characteristics and is more likely to be detected mistakenly.

The alarm sound, capable of being detected by the alarm sound source recognition device disclosed in Japanese Patent Application Laid-open No. 2005-77875, is limited to the alarm sound at a fixed frequency having sharp peak characteristics. The alarm sound source recognition device fails to detect a siren sound whose frequency varies in a long period. Ann engine sound originally has no fixed frequency, for example. The alarm sound source recognition device also fails to detect an alarm sound having no sharp peak characteristics because of frequency variations caused by movement of a sound source and movement of a sound collecting unit as a target alarm sound.

The alarm sound detecting device disclosed in U.S. Pat. No. 7,639,147 carries out a pattern analysis to determine whether or not the frequency and the beat pattern of the obtained audio are identical to the frequency and the beat pattern of the PASS, respectively, thereby detecting an alarm sound. The alarm sound detecting device needs to store therein a plurality of patterns in advance, resulting in an increased circuit scale. In addition, identification of the type of the alarm sound extremely increases the analysis time.

In view of the disadvantages described above, it is an object of the present invention to provide a device and a method for detecting a special signal that detect the presence of a special signal in a short time with a smaller amount of memory and operation without being restricted by the type of a warning sound and use conditions and to provide a device and a method for suppressing a noise signal that suppress the detected special signal as a special noise signal.

It is also an object of the present invention to provide a device and a method for detecting a notification sound that detect the presence of a notification sound in a short time with a smaller amount of memory and operation without being restricted by the type of a notification sound and use conditions, and to provide a device and a method for suppressing a noise signal that suppress the detected notification sound as a special noise signal.

SUMMARY OF THE INVENTION

There is a need to at least partially solve the problems in the conventional technology.

Provided is a noise signal suppressing device including: an input unit configured to receive a sound signal; a time/frequency converting unit configured to convert the sound signal in a time domain into a frequency signal in a frequency domain; an independent peak spectrum extracting unit configured to extract a peak spectrum having independence from the frequency signal that is converted; a persistence determining unit configured to determine, when a predetermined bandwidth, which is centered at a lowest-band peak spectrum out of peak spectra having independence extracted by the independent peak spectrum extracting unit, contains a lowest-band peak spectrum obtained by subsequent frequency conversion, that the peak spectrum having independence persists for a predetermined period or longer; an operating mode determining unit configured to determine whether to suppress a noise signal by a noise-signal suppressing unit; and a noise-signal suppressing unit configured to suppress, based on determination made by the operating mode determining unit, when the persistence determining unit determines that the peak spectrum persists for the predetermined period or longer, the peak spectrum having independence extracted by the independent peak spectrum extracting unit as the noise signal. The independent peak spectrum extracting unit includes: a first peak extracting unit configured to extract a peak spectrum having higher energy than that of an adjacent frequency signal, and a second peak extracting unit configured to extract a peak spectrum maintaining a frequency interval of equal to or larger than a predetermined value with respect to a peak spectrum adjacent thereto from the peak spectrum extracted by the first peak extracting unit as the peak spectrum having independence.

Further provided is a noise signal suppressing method including: converting an input sound signal in a time domain into a frequency signal in a frequency domain; extracting a peak spectrum having independence from the frequency signal that is converted; determining, when a predetermined bandwidth, which is centered at a lowest-band peak spectrum out of peak spectra having independence extracted at the extracting of a peak spectrum having independence, contains a lowest-band peak spectrum obtained by subsequent frequency conversion, that the peak spectrum having independence persists for a predetermined period or longer; determining whether or not to suppress a noise signal; and suppressing, based on determination made at the determining of whether or not to suppress a noise signal, when it is determined that the peak spectrum persists for the predetermined period or longer at the determining of whether the peak spectrum having independence persists, the peak spectrum having independence extracted at the extracting of a peak spectrum having independence as a noise signal. The extracting of a peak spectrum having independence includes: first extracting a peak spectrum having higher energy than that of an adjacent frequency signal, and second extracting a peak spectrum maintaining a frequency interval of equal to or larger than a predetermined value with respect to a peak spectrum adjacent thereto from the peak spectrum extracted at the first extracting as the peak spectrum having independence.

Still further provided is a notification sound detecting device including: an input unit configured to receive a sound signal; a time/frequency converting unit configured to convert the sound signal in a time domain into a frequency signal in a frequency domain; a peak extracting unit configured to extract a peak spectrum having higher energy than that of an adjacent frequency signal from the frequency signal that is converted by the time/frequency converting unit; a lowest-band peak frequency analyzing unit configured to determine whether a lowest-band peak spectrum, out of the peak spectrum extracted by the peak extracting unit, is equal to or higher than a predetermined frequency; a persistence determining unit configured to determine whether the lowest-band peak spectrum, determined to be equal to or higher than the predetermined frequency by the lowest-band peak frequency analyzing unit, persists; and a notification-sound detecting unit configured to detect a notification sound based on a result of determination made by the persistence determining unit.

Still further provided is a notification sound detecting method including: converting an input sound signal in a time domain into a frequency signal in a frequency domain; extracting a peak spectrum having higher energy than that of an adjacent frequency signal from the frequency signal converted at the converting; determining whether a lowest-band peak spectrum out of the peak spectrum extracted at the extracting is equal to or higher than a predetermined frequency; determining whether the lowest-band peak spectrum, which is determined to be equal to or higher than the predetermined frequency at the determining of whether a lowest-band peak spectrum is equal to or higher than a predetermined frequency, persists; and detecting a notification sound based on a result of determination made at the determining of whether the lowest-band peak spectrum persists.

Still further provided is a noise signal suppressing device including: an input unit configured to receive a sound signal; a time/frequency converting unit configured to convert the sound signal in a time domain into a frequency signal in a frequency domain; a peak extracting unit configured to extract a peak spectrum having higher energy than that of an adjacent frequency signal from the frequency signal that is converted by the time/frequency converting unit; a lowest-band peak frequency analyzing unit configured to determine whether a lowest-band peak spectrum out of the peak spectrum extracted by the peak extracting unit is equal to or higher than a predetermined frequency; a persistence determining unit configured to determine whether the lowest-band peak spectrum, which is determined to be equal to or higher than the predetermined frequency by the lowest-band peak frequency analyzing unit, persists; an operating mode determining unit configured to determine whether or not to suppress a noise signal based on a result of determination made by the persistence determining unit; and a noise-signal suppressing unit configured to suppress the noise signal based on determination made by the operating mode determining unit.

Still further provided is a noise signal suppressing method including: converting an input sound signal in a time domain into a frequency signal in a frequency domain; extracting a peak spectrum having higher energy than that of an adjacent frequency signal from the frequency signal converted at the converting; determining whether a lowest-band peak spectrum out of the peak spectrum extracted at the extracting is equal to or higher than a predetermined frequency; determining whether the lowest-band peak spectrum, which is determined to be equal to or higher than the predetermined frequency at the determining, persists; determining operation mode whether or not to suppress a noise signal based on a result of determination made at the determining of whether the lowest-band peak spectrum persists; and suppressing the noise signal based on the determination at the determining operation mode whether or not to suppress a noise signal.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 18A illustrates a chart of a spectrogram waveform obtained when voice coding is performed on a mixed sound signal not subjected to noise suppression processing;

FIG. 18B illustrates a chart of a spectrogram waveform obtained when voice coding is performed on a mixed sound signal having been subjected to noise suppression processing;

FIG. 19 is a spectrogram chart of a notification sound of a life-support system or the like;

DETAILED DESCRIPTION OF THE PREFERRED EMBODIMENTS

Figure 1:
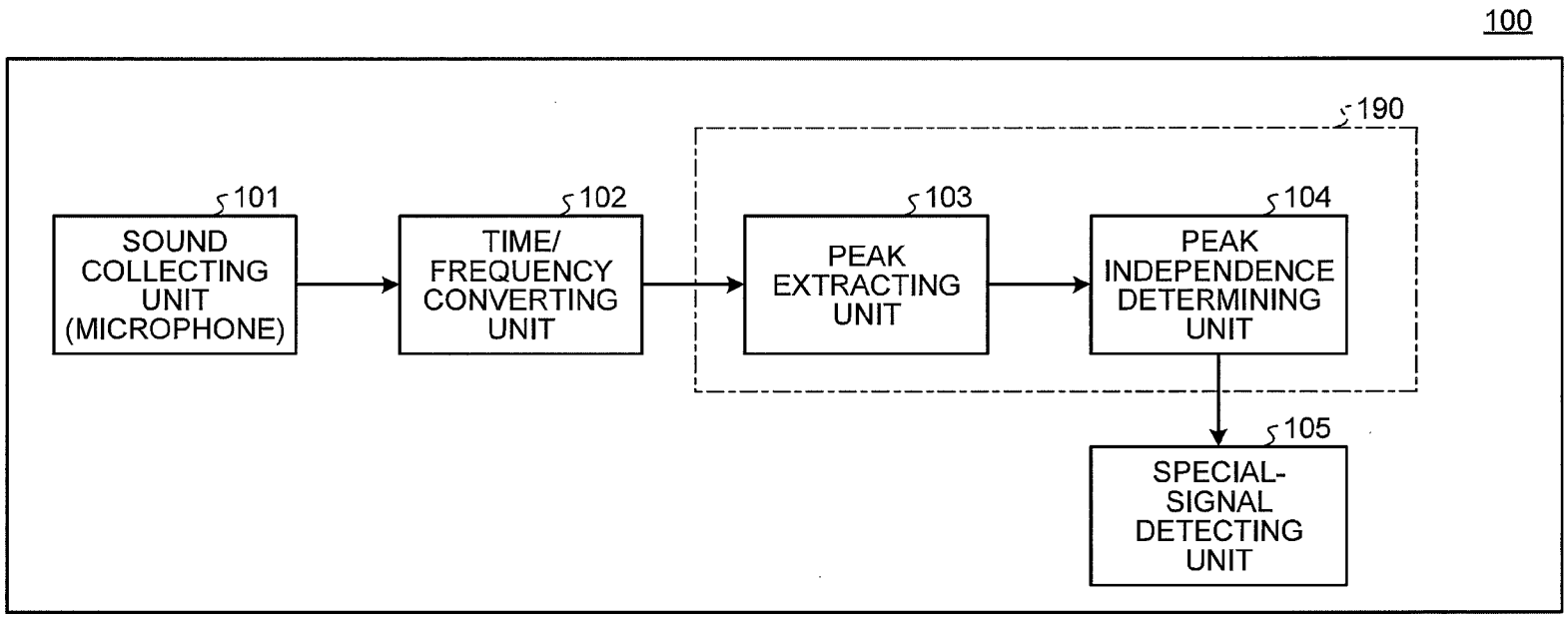
FIG. 1 is a block diagram of the configuration of a special-signal detecting device according to a first embodiment.

Exemplary embodiments are described below with reference to the accompanying drawings. The following describes preferred exemplary embodiments, and the embodiments are not intended to limit the scope of the invention. In the description below, components denoted by similar reference numerals indicate substantially the same contents.

First Embodiment

Embodiments are described below with reference to the accompanying drawings. FIG. 1 is a block diagram of the configuration of a special-signal detecting device according to a first embodiment. A special-signal detecting device 100 includes a sound collecting unit 101, a time/frequency converting unit 102, a peak extracting unit 103, a peak independence determining unit 104, and a special-signal detecting unit 105.

The sound collecting unit 101 collects speech and noise. Specifically, the sound collecting unit 101 is a microphone provided to the special-signal detecting device 100. Ambient sound including a target sound collected by the sound collecting unit 101 is transmitted to the time/frequency converting unit 102 as a sound signal in a time domain. The sound collecting unit 101 may function as an input unit that receives a sound signal. The input unit may receive a sound signal not from the sound collecting unit 101 but from an external sound collecting device, for example.

The time/frequency converting unit 102 converts the sound signal in the time domain acquired by the sound collecting unit 101 into a frequency signal in a frequency domain.

The peak extracting unit 103 extracts a spectrum having an extremely high energy component from the frequency signal converted into a signal in the frequency domain by the time/frequency converting unit 102. Specifically, the peak extracting unit 103 extracts a peak spectrum having peak characteristics of higher energy than that of frequency signals adjacent thereto from the frequency signal.

The peak independence determining unit 104 determines whether the peak extracting unit 103 extracts a peak spectrum. The peak independence determining unit 104 determines whether the peak spectra extracted by the peak extracting unit 103 maintain a frequency interval of equal to or larger than a predetermined value between each other. The peak independence determining unit 104 outputs the determination results to the special-signal detecting unit 105.

The special-signal detecting unit 105 detects the peak spectrum, which is determined to maintain a frequency interval of equal to or larger than the predetermined value with respect to another peak spectrum by the peak independence determining unit 104, as a special signal. In other words, if there is a peak spectrum having a frequency interval of equal to or larger than the predetermined value with respect to another peak spectrum in the peak spectra extracted by the peak extracting unit 103, the special-signal detecting unit 105 detects that peak spectrum as a special signal.

Figure 2:
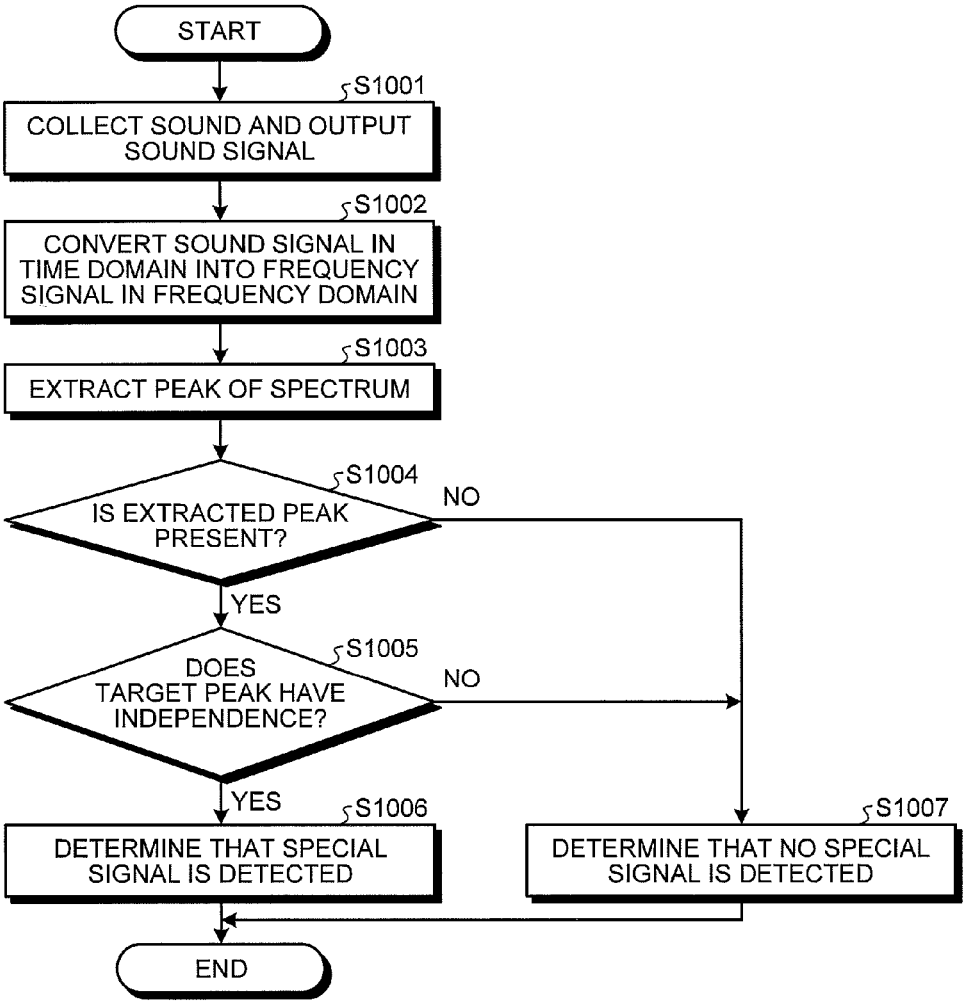
FIG. 2 is a flowchart of an operation of the special-signal detecting device according to the first embodiment.

The following describes an operation of the special-signal detecting device 100. FIG. 2 is a flowchart of an operation of the special-signal detecting device 100.

The sound collecting unit 101 collects ambient sound, and outputs the collected sound as a sound signal in the time domain to the time/frequency converting unit 102 (Step S1001).

The time/frequency converting unit 102 performs time/frequency conversion on the input signal; thereby converting the input signal into a frequency signal which is a signal in the frequency domain, and outputting the converted frequency signal to the peak extracting unit 103 (Step S1002).

The peak extracting unit 103 carries out a spectrum analysis on the received frequency signal and extracts a peak spectrum (Step S1003). Specifically, the peak extracting unit 103 compares the average value of energy of all the spectra with energy of a spectrum at each point to determine whether the spectrum has peak characteristics, thereby extracting a peak spectrum.

The peak independence determining unit 104 determines whether a peak spectrum is extracted at Step S1003 (Step S1004). If no peak spectrum is extracted, the special-signal detecting unit 105 determines that no special signal is detected (Step S1007).

By contrast, if a peak spectrum is extracted at Step S1003, the peak independence determining unit 104 determines the independence of the extracted peak spectrum (Step S1005). Specifically, the peak independence determining unit 104 determines whether the peak spectra extracted at Step S1003 maintain a frequency interval of equal to or larger than a predetermined value therebetween.

If it is determined that no peak spectrum having independence is present at Step S1005, the special-signal detecting unit 105 determines that no special signal is detected (Step S1007). By contrast, if it is determined that a peak spectrum having independence is present at Step S1005, the special-signal detecting unit 105 determines that the peak spectrum is caused by a special signal and detects the special signal (Step S1006).

As described above, the special-signal detecting device according to the first embodiment extracts a peak spectrum and determines the independence of the peak spectrum, thereby detecting a special signal. This configuration can detect the presence of a special signal in a short time with a smaller amount of memory and operation.

Because the peak extracting unit 103 and the peak independence determining unit 104 cooperate to extract a peak spectrum having independence, these two units may be collectively referred to as an independent peak spectrum extracting unit 190 in the description below. The special-signal detecting unit 105 detects a special signal based on the independent peak spectrum extracted by the independent peak spectrum extracting unit 190.

The special-signal detecting device is applicable to various uses. The special-signal detecting device, for example, is applicable to a notification device. The notification device uses the special-signal detecting device to detect a special signal such as an alarm sound. If the special signal is detected, the notification device notifies an operator standing by at another place that the alarm sound is ringing. The special-signal detecting device is also applicable to a measurement device. The measurement device uses the special-signal detecting device placed at the side of a road to detect a special signal such as an engine sound of a vehicle. The measurement device records the detection result chronologically in a memory, thereby measuring the amount of traffic.

The special-signal detecting device is also applicable to a noise signal suppressing device. The noise-signal suppressing device regards a special signal detected by the special-signal detecting device as special noise and removes the special noise from the collected sound before transmitting the speech.

Figure 3:
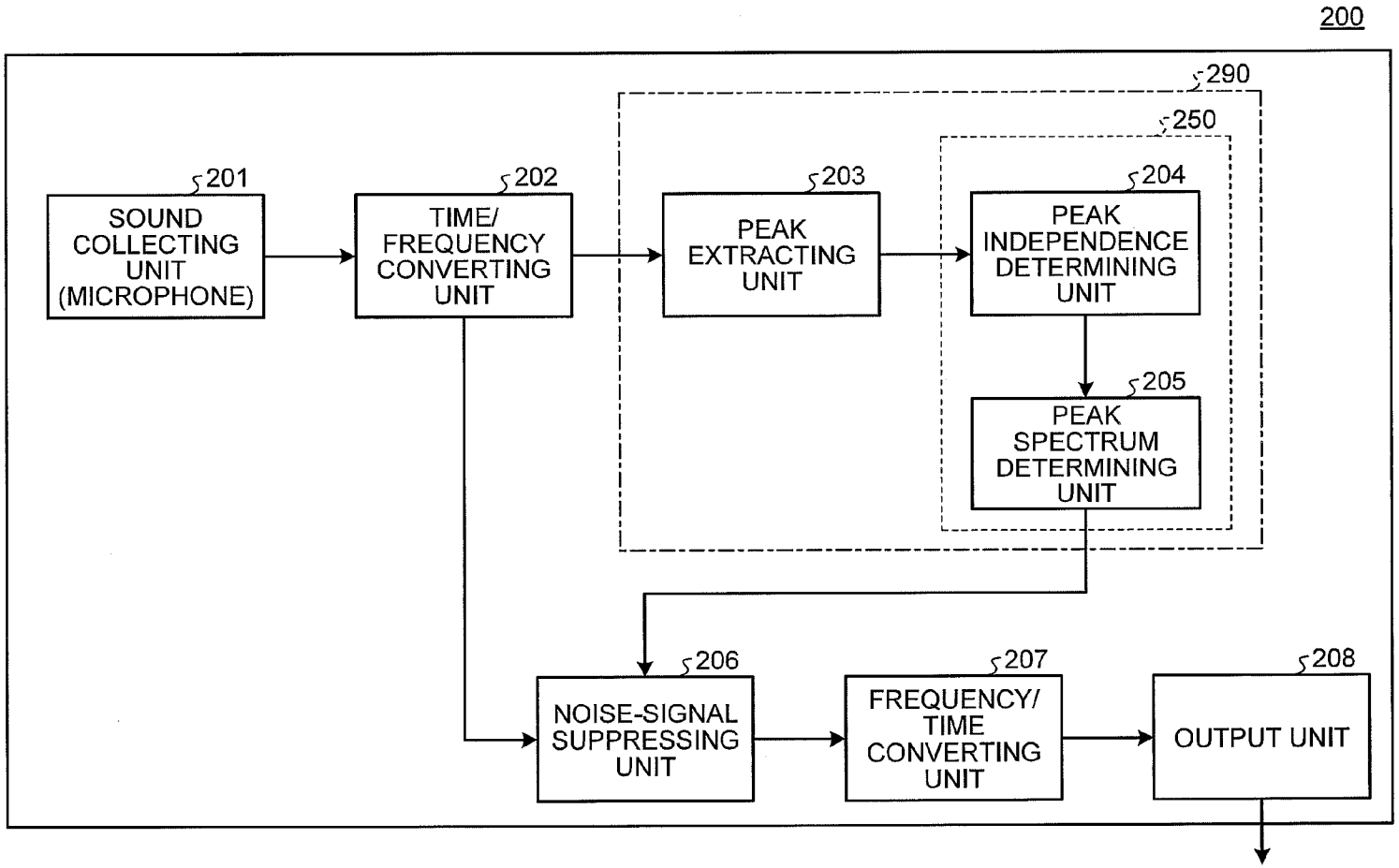
FIG. 3 is a block diagram of the configuration of a noise signal suppressing device according to the first embodiment.

FIG. 3 is a block diagram of the configuration of a noise-signal suppressing device 200 according to the first embodiment employing the special-signal detecting method.

The noise-signal suppressing device 200 includes a sound collecting unit 201, a time/frequency converting unit 202, a peak extracting unit 203, a peak independence determining unit 204, a peak spectrum determining unit 205, a noise-signal suppressing unit 206, a frequency/time converting unit 207, and an output unit 208.

The sound collecting unit 201, the time/frequency converting unit 202, the peak extracting unit 203, and the peak independence determining unit 204 included in the noise-signal suppressing device 200 correspond to the sound collecting unit 101, the time/frequency converting unit 102, the peak extracting unit 103, and the peak independence determining unit 104 included in the special-signal detecting device 100, respectively.

The sound collecting unit 201 collects speech and noise. Specifically, the sound collecting unit 201 is a microphone provided to the noise-signal suppressing device 200. Ambient sound including a target sound collected by the sound collecting unit 201 is transmitted to the time/frequency converting unit 202 as a sound signal in the time domain. The sound collecting unit 201 may function as an input unit that receives a sound signal. The input unit may receive a sound signal not from the sound collecting unit 201 but from an external sound collecting device, for example.

The time/frequency converting unit 202 converts the sound signal in the time domain acquired by the sound collecting unit 201 into a frequency signal in the frequency domain.

The peak extracting unit 203 extracts a spectrum having an extremely high energy component from the frequency signal converted into a signal in the frequency domain by the time/frequency converting unit 202.

The peak independence determining unit 204 determines whether the peak spectra extracted by the peak extracting unit 203 maintain a predetermined frequency interval therebetween.

The peak spectrum determining unit 205 extracts a spectrum determined to have independence by the peak independence determining unit 204 as a special noise signal.

The noise-signal suppressing unit 206 removes the peak spectrum extracted as the special noise signal by the peak spectrum determining unit 205 from the frequency signals in the frequency domain output from the time/frequency converting unit 202. The noise-signal suppressing unit 206 outputs the frequency signal having been subjected to the noise suppression to the frequency/time converting unit 207.

The frequency/time converting unit 207 converts the frequency signal, which is received from the noise-signal suppressing unit 206, into a sound signal in the time domain. The frequency/time converting unit 207 outputs the converted sound signal to the output unit 208.

The output unit 208 performs voice coding on the sound signal received from the frequency/time converting unit 207 as needed and outputs the sound signal to the outside. The output unit 208 may be a wireless transmission unit that wirelessly transmits the received sound signal to the outside.

The peak extracting unit 203, the peak independence determining unit 204, and the peak spectrum determining unit 205 cooperate to extract a peak spectrum having independence from the frequency signal having been subjected to the frequency conversion. In the description below, these three units may be collectively referred to as an independent peak spectrum extracting unit 290. The independent peak spectrum extracting unit 290 extracts a peak spectrum having independence from the frequency signal. Having independence means maintaining a frequency interval of equal to or larger than a predetermined value with respect to an adjacent peak spectrum. Considering that speech has its fundamental frequency at 100 Hz to 400 Hz, the predetermined value is preferably set to approximately 400 Hz.

In the independent peak spectrum extracting unit 290, the peak extracting unit 203 extracts peak spectra of the first stage without considering the independence from all the spectra, whereas the peak independence determining unit 204 and the peak spectrum determining unit 205 extract peak spectra of the second stage considering the independence from the peak spectra extracted at the first stage. In the description below, the peak independence determining unit 204 and the peak spectrum determining unit 205 may be collectively referred to as a second peak extracting unit 250. The peak extracting unit 203 may be specifically referred to as a first peak extracting unit 203.

The first peak extracting unit 203 preferably extracts a spectrum satisfying the following conditions as a peak spectrum: the sound pressure level of the sound signal collected by the sound collecting unit 201 is equal to or higher than a first reference value (e.g., 80 dB); and the difference in level between the sound pressure level of the spectrum and an average signal level of all the frequency spectra is equal to or larger than a second reference value (e.g., 12 dB). This enables the first peak extracting unit 203 to appropriately extract a peak of special noise.

Figure 4:
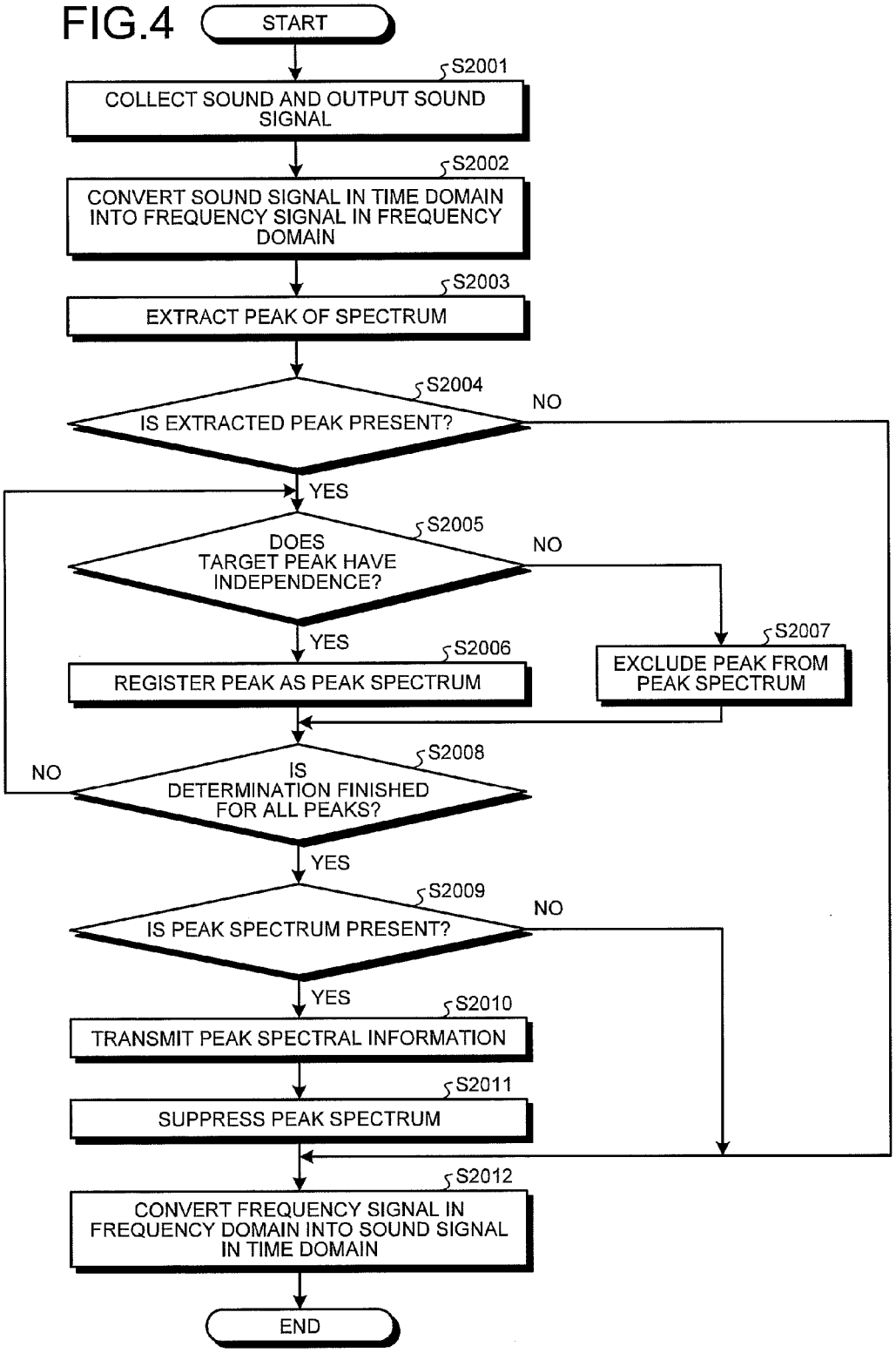
FIG. 4 is a flowchart of an operation of the noise-signal suppressing device according to the first embodiment.

The following describes an operation of the noise-signal suppressing device 200. FIG. 4 is a flowchart of an operation of the noise-signal suppressing device 200.

The sound collecting unit 201 collects ambient sound and outputs the collected sound as a sound signal in the time domain to the time/frequency converting unit 202 (Step S2001).

The time/frequency converting unit 202 performs time/frequency conversion on the input signal, thereby converting the input signal into a frequency signal, which is a signal in the frequency domain (Step S2002).

The time/frequency converting unit 202 performs the time/frequency conversion in units of sample groups formed in predetermined duration. The frequency resolution in the conversion is determined based on a sampling rate of the sound signal received from the sound collecting unit 201 and the number of samples of the time/frequency converting unit 202, and is expressed by Expression (1):

$$\text{Frequency Resolution} = \frac{\left(\frac{\text{Sampling Rate}}{2}\right)}{\text{Number of Samples}}[Hz] \tag{1}$$

An assumption is made that the sampling rate is 32000 Hz and that the number of samples of the time/frequency converting unit 202 is 512, for example. In this case, the frequency resolution is 31.25 Hz according to Expression (1). The duration for the frequency conversion is expressed by Expression (2):

$$\text{Frequency Conversion Duration} = \tag{2}$$

-continued $$\text{Number of Samples} \times \left(\frac{1}{\text{Sampling Rate}}\right)[Sec]$$

In the example above, the frequency conversion duration is 0.016 sec. Thus, the noise-signal suppressing device 200 repeats the time/frequency conversion in units of 512 samples in a period of 0.016 sec.

The peak extracting unit 203 extracts a peak spectrum having peak characteristics of higher energy than that of frequency signals adjacent thereto from the frequency signals converted by the time/frequency converting unit 202 (Step S2003).

Specifically, the peak extracting unit 203 calculates the average value of energy of all the spectra and compares the average value of all the calculated spectra with the energy of each spectrum. Given n represents the number of samples relating to frequency conversion, the average energy of all the spectra is expressed by Expression (3):

$$\text{Average Value of All Spectra} = \frac{\text{Spectral } Intensity_1 + \text{Spectral } Intensity_2 + \ldots + \text{Spectral } Intensity_n}{n} \quad (3)$$

The peak extracting unit 203 determines whether a target spectrum has a higher energy ratio with respect to the energy of spectra adjacent thereto (energy of an average spectrum), that is, whether the spectrum has peak characteristics; thereby extracting a peak of the spectrum.

The articulation required to transmit a sound signal is usually equal to or higher than 12 dB in the signal-to-noise energy ratio (SNR) (a sound signal is more than four-times higher than a noise signal in amplitude equivalent). A warning sound, such as a siren sound, has an extremely high degree of concentration in the frequency domain (tone noise, that is, a group of sine waves). In a process of voice coding, the excessively large frequency component causes the amount of information required for coding of a sound signal to be used for coding of the warning sound, resulting in deterioration in the quality of the sound signal.

In typical voice coding, when the energy of the fundamental frequency component of a sound signal exceeds that of the main frequency component of a warning sound, information tends to be preferentially allocated to the sound signal. By contrast, when the energy of the fundamental frequency component of a sound signal falls below that of the main frequency component of a warning sound, the warning sound having high tone characteristics is regarded as a speech component, and information tends to be preferentially allocated to the warning sound.

Based on the tendency described above, it is determined whether the energy component of the warning sound is excessively large using a reference value of 12 dB, which is an SNR required for transmission. A spectrum having higher energy than the average energy by 12 dB or more is preferably extracted as a peak spectrum.

The present embodiment uses the average energy of all the spectra for the comparison. In consideration of various types of frequency distributions of ambient noise, however, the determination may be made using the average energy of a predetermined bandwidth obtained by dividing the entire frequency band.

Figure 5:
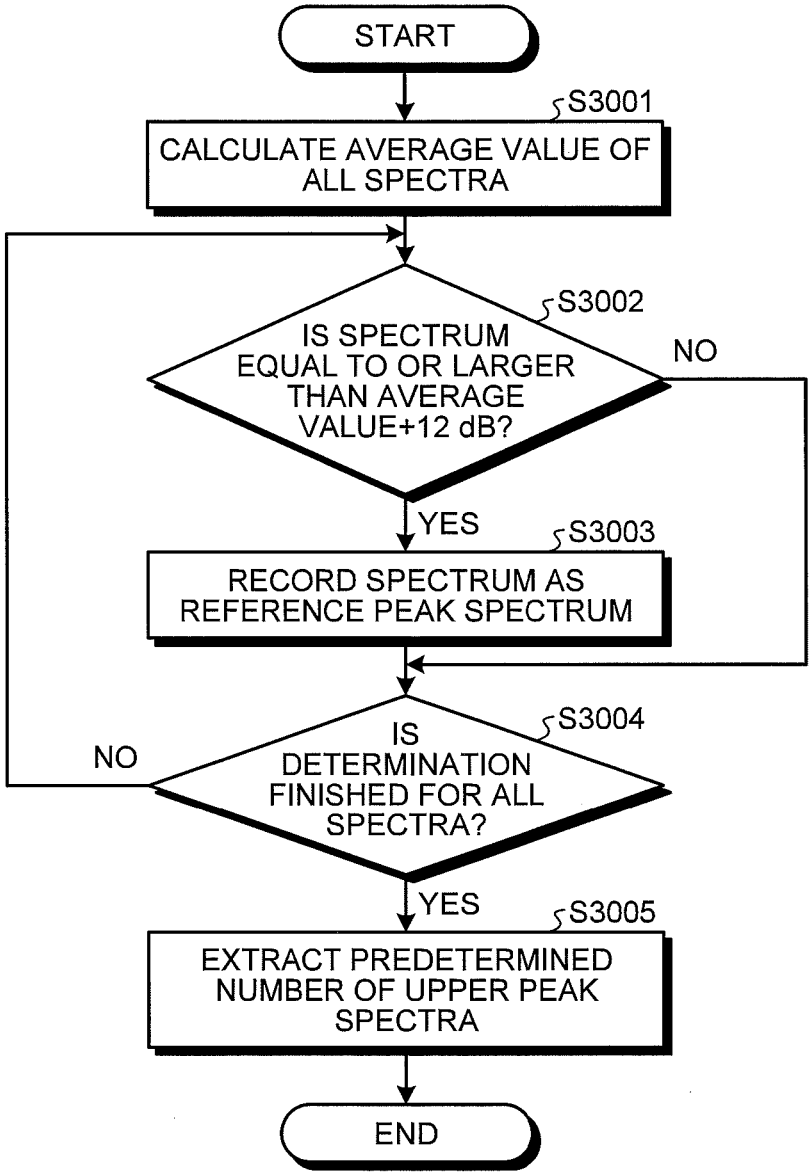
FIG. 5 is a flowchart of a peak spectrum extracting operation according to the first embodiment.

The following describes the peak extraction processing performed at Step S2003 in more detail with reference to FIG. 5. FIG. 5 is a flowchart of the peak extraction processing performed by the peak extracting unit 203.

The peak extracting unit 203 calculates the average value of the entire input spectrum signal (Step S3001). The peak extracting unit 203 makes a comparison to determine whether each spectrum exceeds a value obtained by adding +12 dB, which is a reference of the SNR, to the average value of the entire spectrum signal calculated at Step S3001 (Step S3002). If the result of comparison indicates that the value of the compared spectrum signal is larger than the value obtained by adding +12 dB to the average value of all the spectra, the system control goes to Step S3003. Otherwise, the system control goes to Step S3004.

The peak extracting unit 203 records each spectrum whose value is determined to be larger than the value obtained by adding +12 dB to the average value of all the spectra as a result of comparison made at Step S3002 as a reference peak spectrum (Step S3003).

If the peak extracting unit 203 performs the comparison processing of each spectrum on all the spectra, the system control goes to Step S3005. If the peak extracting unit 203 does not perform the comparison processing on all the spectra yet, the system control goes to Step S3002 to make a comparison of the next spectrum (Step S3004).

The peak extracting unit 203 extracts a predetermined number of upper peak spectra having a higher energy amount from the reference peak spectra temporarily extracted at Step S3003 as peak spectra (Step S3005).

In the registration processing of the peak spectra which will be described later, a peak spectrum having a frequency interval of equal to or larger than 400 Hz is eventually registered as a peak. In the case of a sound signal converted into a digital signal typically having a frequency range of 100 to 3500 Hz, a signal having a harmonic structure of equal to or larger than 400 Hz is extracted at approximately eight points. Thus, the number of peaks to be extracted simply needs to be set to this level. In consideration of influences of a plurality of mixed sounds and a sound mixed with a sound signal, it is sufficient to extract approximately 10 to 20 peak spectra. Selecting a required number of peak spectra from the temporarily extracted reference peak spectra can reduce the load of subsequent processing.

Thus, the peak extracting unit 203 extracts peak spectra having peak characteristics of higher energy than that of frequency signals adjacent thereto in accordance with the processing flow from Step S3001 to Step S3005.

Referring back to the flowchart in FIG. 4, peak independence determination processing will be described. The peak independence determining unit 204 determines whether a peak spectrum having peak characteristics is extracted from all the frequency spectra in the peak extraction processing performed by the peak extracting unit 203 (Step S2004). If no peak spectrum is extracted by the peak extracting unit 203, it is determined that no special noise such as a warning sound is present, or is determined that special noise having a sufficiently low energy component is present. As a result, the noise-signal suppressing unit 206 does not perform noise suppression processing, which will be described later, and the system control goes to Step S2012.

By contrast, if the result of determination made at Step S2004 indicates that a peak spectrum is extracted, the peak independence determining unit 204 starts to determine whether or not the extracted peak spectrum is special noise such as a warning sound. Because a voice signal may possibly be included in the extracted peak spectrum, it is not appropriate to automatically determine the extracted peak spectrum to be special noise.

Based on the fact that a harmonic component, which is a characteristic of speech, is distributed in high density, the peak independence determining unit 204 makes determination of peak independence. Thus, the peak independence determining unit 204 determines whether the extracted peak spectrum is caused by a sound signal or special noise (Step S2005). In other words, the peak independence determining unit 204 separates a sound signal from special noise based on the independence of the peak signal itself, that is, the distance of frequency between the peak signal and another extracted peak signal.

A warning sound such as a siren sound and a high-pitched engine sound of a racing car have characteristics common to those of voice (speech) in terms of the composition formed of overlapping harmonic components based on a fundamental frequency. Special noise such as a warning sound is significantly different from speech of a human in the fundamental frequency. Speech has its fundamental frequency at approximately 100 to 400 Hz, whereas most of the special noise has its fundamental frequency at 400 Hz or higher (excluding engine sounds having an intense low-band component).

Based on the characteristics described above, the peak independence determining unit 204 sets a reference frequency interval to 400 Hz and determines whether the distance of frequency between the detected peak spectra is equal to or larger than 400 Hz at Step S2005, for example.

To detect another peak spectrum in a bandwidth of 400 Hz of the minimum unit, the following frequency resolution is required. Assuming that a bandwidth of 400 Hz has first peaks (peaks, or mountain) on both ends, the frequency resolution needs to be sufficiently high to observe a second peak (peak, or mountain) at around 200 Hz corresponding to an intermediate point between both ends and lower sound pressure levels (troughs, or valley) on both sides of the second peak (between the first peak and the second peak). To accurately determine whether the distance between peak spectra is equal to or larger than 400 Hz, the time/frequency converting unit 202 preferably has a frequency resolution of 100 Hz that enables observation of at least another peak (peak).

If the frequency interval between a target peak spectrum and a peak spectrum adjacent thereto is smaller than 400 Hz, the peak independence determining unit 204 determines the target peak spectrum to be a speech spectrum signal. By contrast, if the frequency interval is equal to or larger than 400 Hz, the peak independence determining unit 204 determines the target peak spectrum to be a special noise signal.

The peak spectrum determining unit 205 registers a peak spectrum determined to have a frequency interval of equal to or larger than 400 Hz as a result of determination made by the peak independence determining unit 204 at Step S2005 (Step S2006). By contrast, the peak spectrum determining unit 205 excludes a peak spectrum determined to have a frequency interval of smaller than 400 Hz as a result of determination made at Step S2005 (Step S2007).

When speech and a special noise signal are simultaneously received, the spectrum of a low-band part of the special noise signal overlaps with the distribution of the sound signal. The method for separating speech from special noise based on the peak independence described above excludes the special noise component of the low-band part together with the speech as the determination result of peak independence, thereby preventing the special noise from being perfectly separated. Suppressing a peak spectrum in a mid-high-band of the special noise signal makes it possible to alleviate the influence on deterioration in the quality of the sound signal in voice coding as described above.

As described above, the peak independence determining unit 204 determines whether the interval between a target peak spectrum and a peak spectrum adjacent thereto is equal to or larger than a predetermined frequency interval (400 Hz in the present embodiment) at Step S2005. If the determination result indicates that the interval between the peak spectra is equal to or larger than 400 Hz, no other peak spectrum is present near the target peak spectrum, and it is determined that "the target peak spectrum has independence". The peak spectrum determining unit 205 registers the corresponding spectral information as a proper peak spectrum at Step S2006. By contrast, if the interval between the peak spectra is smaller than 400 Hz, another peak spectrum is present near the target peak spectrum, and it is determined that "the target peak spectrum has no independence". In this case, the peak spectrum determining unit 205 excludes the corresponding spectral information from spectrum candidates of the special noise at Step S2007.

The peak independence determining unit 204 determines whether the determination processing of the presence of independence is finished for all the peak spectra (Step S2008). If the determination result indicates that the processing is being performed, the system control returns to Step S2005 for determination of the next peak spectrum. By contrast, if the processing is finished for all the peak spectra, the system control goes to Step S2009 to determine whether a registered peak spectrum is present.

When the determination of all the peaks is finished, the peak spectrum determining unit 205 determines whether a peak spectrum having independence is registered at Step S2006 (Step S2009). If the determination result indicates that no peak spectrum having independence is registered, the peak spectrum determining unit 205 determines that all the peak spectra extracted at Step S2004 are peak spectra relating to speech and that no special noise signal is present. The system control goes to Step S2012.

By contrast, if a peak spectrum having independence is registered, the peak spectrum determining unit 205 transmits information on the peak spectrum to the noise-signal suppressing unit 206 (Step S2010).

The noise-signal suppressing unit 206 uses the information on the peak spectrum to be suppressed as a special noise signal for the peak spectrum extracted by the time/frequency converting unit 202, thereby performing noise suppression processing (Step S2011). In the noise suppression processing, a predetermined level reduction amount is applied similarly to the conventional noise reduction processing. The suppression amount in the suppression processing performed by the noise-signal suppressing unit 206 may be the difference between the average spectrum energy and the peak spectrum in the unit of frequency conversion detected at the previous stage, or may be a suppression amount exceeding 12 dB, which is a reference for extraction of a peak spectrum.

The frequency/time converting unit 207 performs frequency/time conversion on the frequency signal obtained by performing the suppression processing on the peak spectrum; acquires a speech output signal in the time domain; and outputs the speech output signal to the output unit 208 (Step S2012).

If no peak spectrum is detected, the peak spectrum determining unit 205 transmits no peak spectral information to the noise-signal suppressing unit 206. In this case, the noise-signal suppressing unit 206 directly transmits the frequency signal received from the time/frequency converting unit 202, without performing the noise suppression processing, to the frequency/time converting unit 207.

The following describes the functions of the peak extracting unit 203, the peak independence determining unit 204, and the peak spectrum determining unit 205 in more detail.

Figure 6:
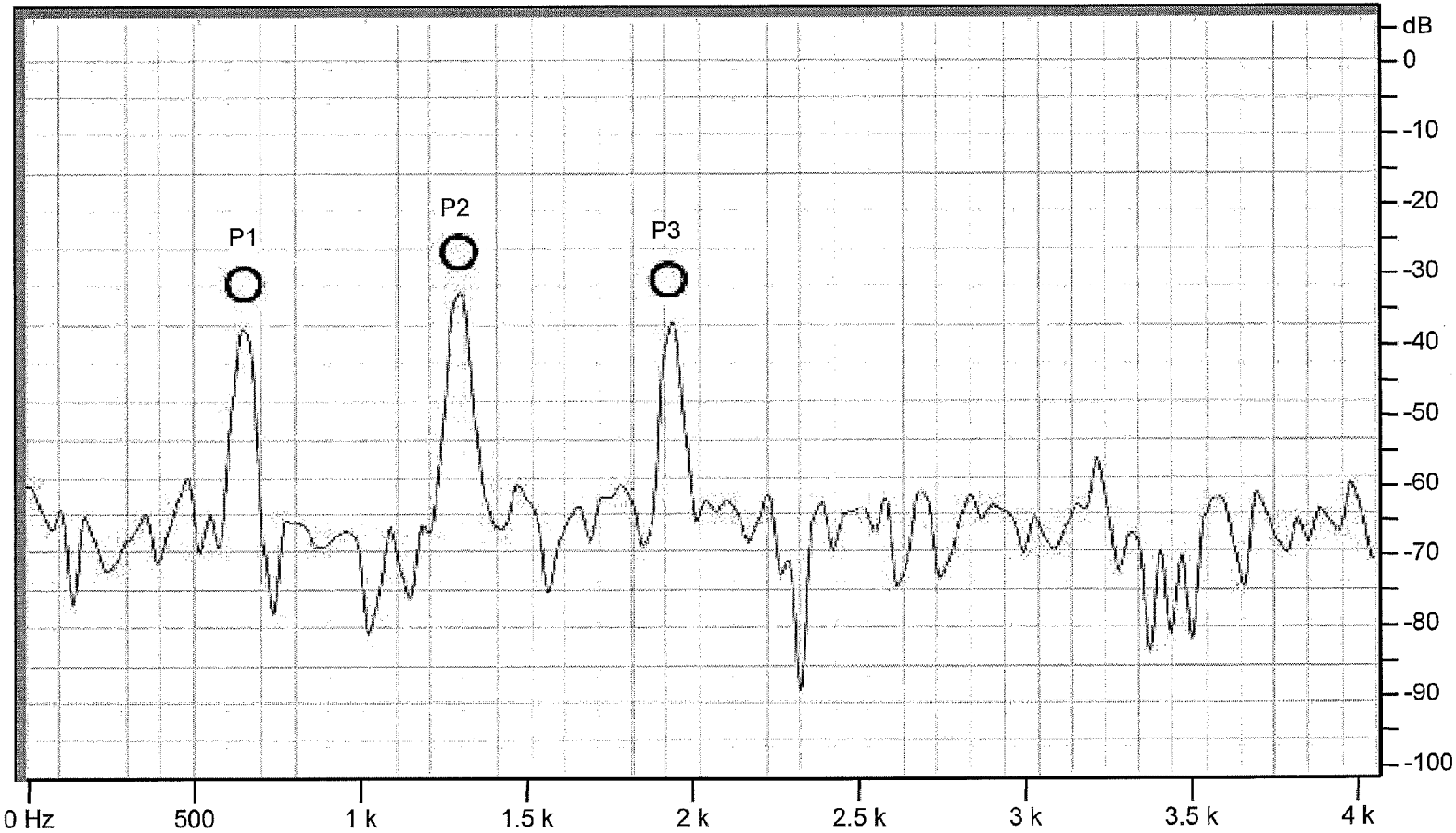
FIG. 6 is a frequency distribution chart illustrating a case in which a siren sound is collected.

FIG. 6 is a frequency distribution chart illustrating a case in which a siren sound at a high sound pressure level is collected by the sound collecting unit 201 under the condition of low-level ambient noise and subjected to time/frequency conversion. The abscissa represents the frequency of a range from 0 to 4 kHz, whereas the ordinate represents the sound pressure level.

In this example, a spectrum having the highest sound pressure level exceeds 100 dB, and three peak spectra (open circles) are detected as peak spectra having a higher peak than an average sound pressure level by 12 dB or more. The detected peak spectra are referred to as peak spectra P1, P2, and P3. The peak spectra P1 to P3 are extracted by the peak extracting unit 203. Because the peak spectra P1 to P3 maintain frequency intervals of equal to or larger than 400 Hz, the peak spectra P1 to P3 keep independence. The peak independence determining unit 204 determines that the peak spectra P1 to P3 are independent. The peak spectrum determining unit 205 determines that the peak spectra P1 to P3 are caused by special noise and transmits information on the peak spectra to the noise-signal suppressing unit 206. The noise-signal suppressing unit 206 performs suppression processing on the three peak spectra P1 to P3.

Figure 7:
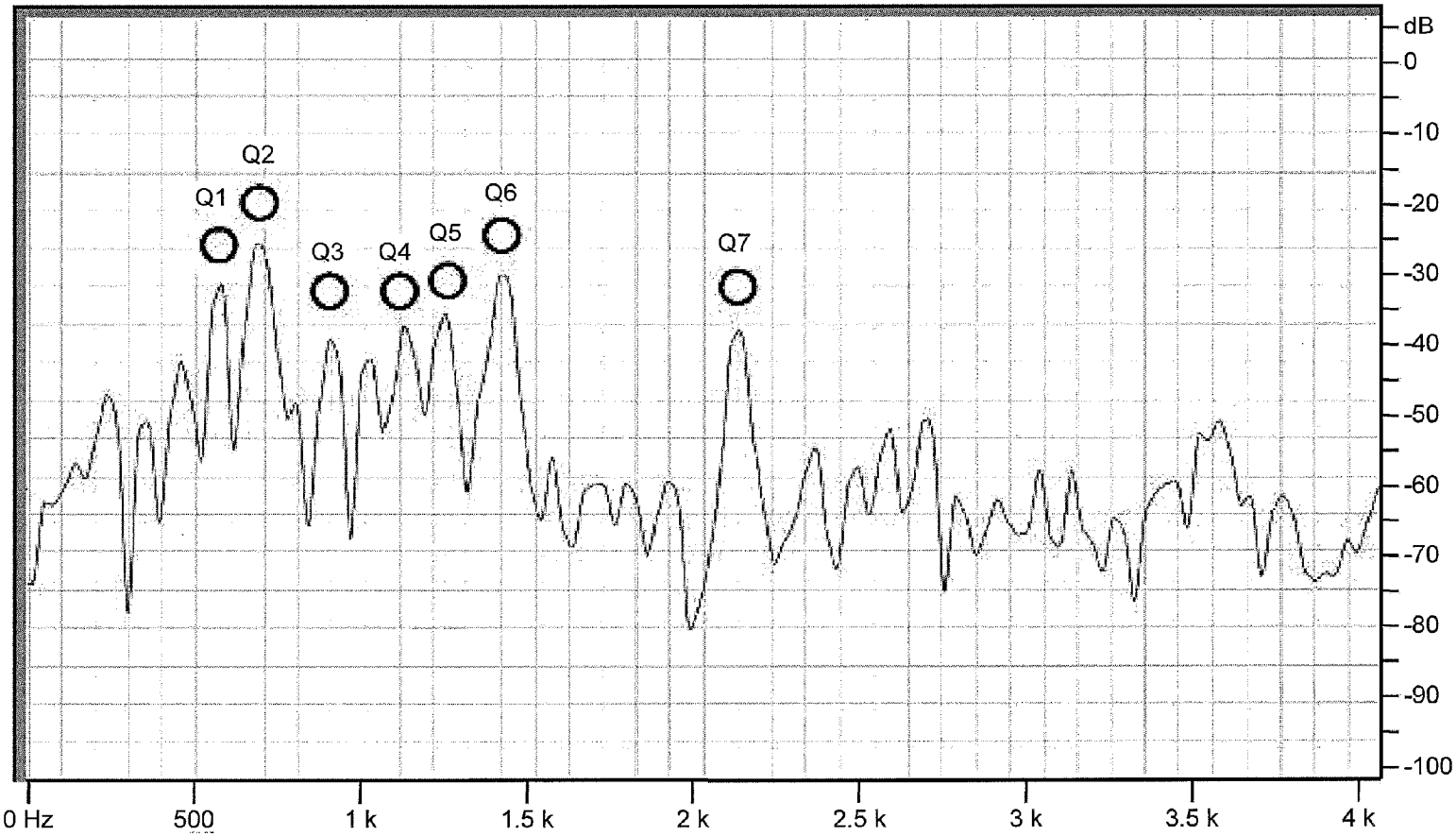
FIG. 7 is a frequency distribution chart illustrating a case in which a siren sound and speech of a human are simultaneously collected.

FIG. 7 is a frequency distribution chart illustrating a case in which a siren sound at a high sound pressure level and a voice signal output simultaneously with the siren sound are collected by the sound collecting unit 201 under the condition of low-level ambient noise and subjected to time/frequency conversion. In addition to the siren sound observed in FIG. 6, speech spectra are observed and found to overlap with the lowest-band spectra of the siren sound. Detected peaks are indicated by open circles in the same manner as described above. In this case, seven peak spectra Q1 to Q7 are extracted by the peak extracting unit 203 as illustrated in FIG. 7. The peak spectra Q1 to Q6 on the low-band side have no frequency intervals of equal to or larger than 400 Hz and thus keep no independence. The peak spectrum determining unit 205 excludes the peaks Q1 to Q6, and registers the peak Q7 alone as a peak spectrum. The peak spectrum determining unit 205 determines that the peak spectrum Q7 is caused by special noise and transmits information thereof on the peak spectrum to the noise-signal suppressing unit 206. The noise-signal suppressing unit 206 performs suppression processing on the peak spectrum Q7 independently present on the highest-band side. By contrast, the peak spectra Q1 to Q6 are determined to be caused by the speech and are not to be subjected to the suppression processing.

Peak spectra caused by the siren sound are actually included in the peak spectra Q1 to Q6, but the peak spectra of the siren sound in the low-frequency range are not excluded. This is because the configuration can suppress the peak spectrum Q7, thereby achieving improvement in speech in a short time and with a smaller amount of operation.

While the explanation has been made only of the suppression processing of a special noise signal performed by the noise-signal suppressing device according to the first embodiment, the noise-signal suppressing device may perform noise-signal suppression processing in the frequency domain as typified by the conventional spectral subtraction method besides the suppression processing. It is also possible to additionally introduce the suppression processing technology of a special noise signal according to the first embodiment into a device in the frequency domain as typified by the conventional spectral subtraction method. This combination can provide a special-noise-signal suppressing device also having the conventional noise-signal suppression effects. This makes it possible to provide a noise suppressing device that can reduce ambient noise together with a warning sound, such as a siren sound.

The specific numerical values described above are optimum for the advantageous effects of the present embodiment. The optimum value of the sound pressure level varies depending on the ambient noise environment and the frequency resolution (low resolution tends to average the sound pressure level and ambient frequency components, thereby lowering the sound pressure level). The specific numerical values described above are not intended to limit the present invention. The peak independence determining unit 204 may employ 300 Hz or 500 Hz as a reference value for determination of independence instead of 400 Hz, for example.

The special-signal detecting device 100 and the noise-signal suppressing device 200 may further include a sound pressure level measuring unit that measures the sound pressure level of the sound signal collected by the sound collecting unit 101. When the sound pressure level measured by the sound pressure level measuring unit exceeds a predetermined reference value, the special signal detection processing and the special-noise suppression processing may be performed.

In the description above, the independent peak spectrum extracting unit 290 extracts a peak spectrum having independence from the frequency signals converted by the time/frequency converting unit 202, and the noise-signal suppressing unit 206 suppresses the peak spectrum having independence as a noise signal. The present embodiment is not limited thereto. The noise-signal suppressing unit 206 may suppress noise by subtracting a signal in the time domain obtained by the frequency/time converting unit 207 converting the extracted peak spectrum having independence from the sound signals in the time domain collected by the sound collecting unit 201.

Obviously, the specific detection method for special noise described in the noise-signal suppressing device 200 is applicable to the special-signal detecting device 100 illustrated in FIG. 1.

Second Embodiment

The special-signal detecting device according to the first embodiment detects a peak spectrum having independence as a special signal of a siren sound, a warning sound, or the like. When unexpected pulse noise is collected by the sound collecting unit, however, the special-signal detecting device detects the noise as a special signal. To address this, a special-signal detecting device according to a second embodiment detects a special signal more appropriately. The special-signal detecting device according to the second embodiment is described below in more detail with reference to the accompanying drawings. An explanation of the components already described in the first embodiment will be partially omitted for clarification of the invention.

Figure 8:
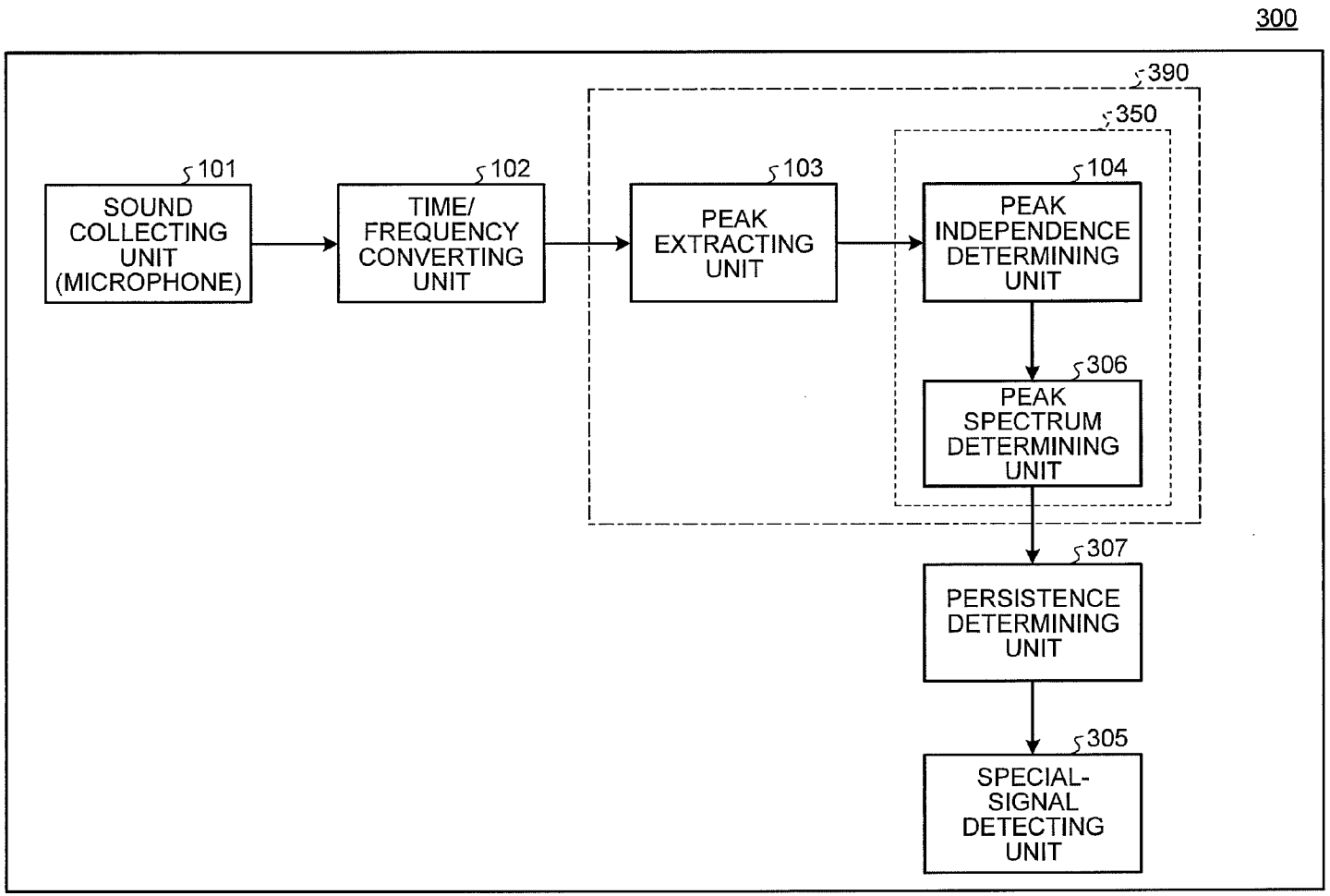
FIG. 8 is a block diagram of the configuration of a special-signal detecting device according to a second embodiment.

FIG. 8 is a block diagram of the configuration of a special-signal detecting device 300 according to the second embodiment. The special-signal detecting device 300 includes a sound collecting unit 101, a time/frequency converting unit 102, a peak extracting unit 103, a peak independence determining unit 104, a special-signal detecting unit 305, a peak spectrum determining unit 306, and a persistence determining unit 307.

The peak spectrum determining unit 306 determines a peak spectrum determined to have independence by the peak independence determining unit 104 as a peak spectrum candidate caused by a special signal.

The persistence determining unit 307 determines the persistence of the peak spectrum determined to be a peak spectrum candidate caused by a special signal by the peak spectrum determining unit 306. In other words, the persistence determining unit 307 determines whether the peak spectrum determined to be a peak spectrum candidate caused by a special signal by the peak spectrum determining unit 306 persists for a predetermined period.

If the persistence determining unit 307 determines a peak spectrum to be caused by a special signal when the peak spectrum persists for the predetermined period, the special-signal detecting unit 305 determines the peak spectrum to be caused by a special signal, thereby detecting the special signal.

The peak extracting unit 103, the peak independence determining unit 104, and the peak spectrum determining unit 306 are collectively referred to as an independent peak spectrum extracting unit 390. The independent peak spectrum extracting unit 390 extracts a peak spectrum having independence from the frequency signals having been subjected to frequency conversion.

The peak independence determining unit 104 and the peak spectrum determining unit 306 may be collectively referred to as a second peak extracting unit 350. The peak extracting unit 103 may be specifically referred to as a first peak extracting unit 103. The second peak extracting unit 350 extracts a peak spectrum maintaining a frequency interval of equal to or larger than a predetermined value with respect to a peak spectrum adjacent thereto from the peak spectra extracted by the first peak extracting unit 103 as a peak spectrum having independence.

Figure 9:
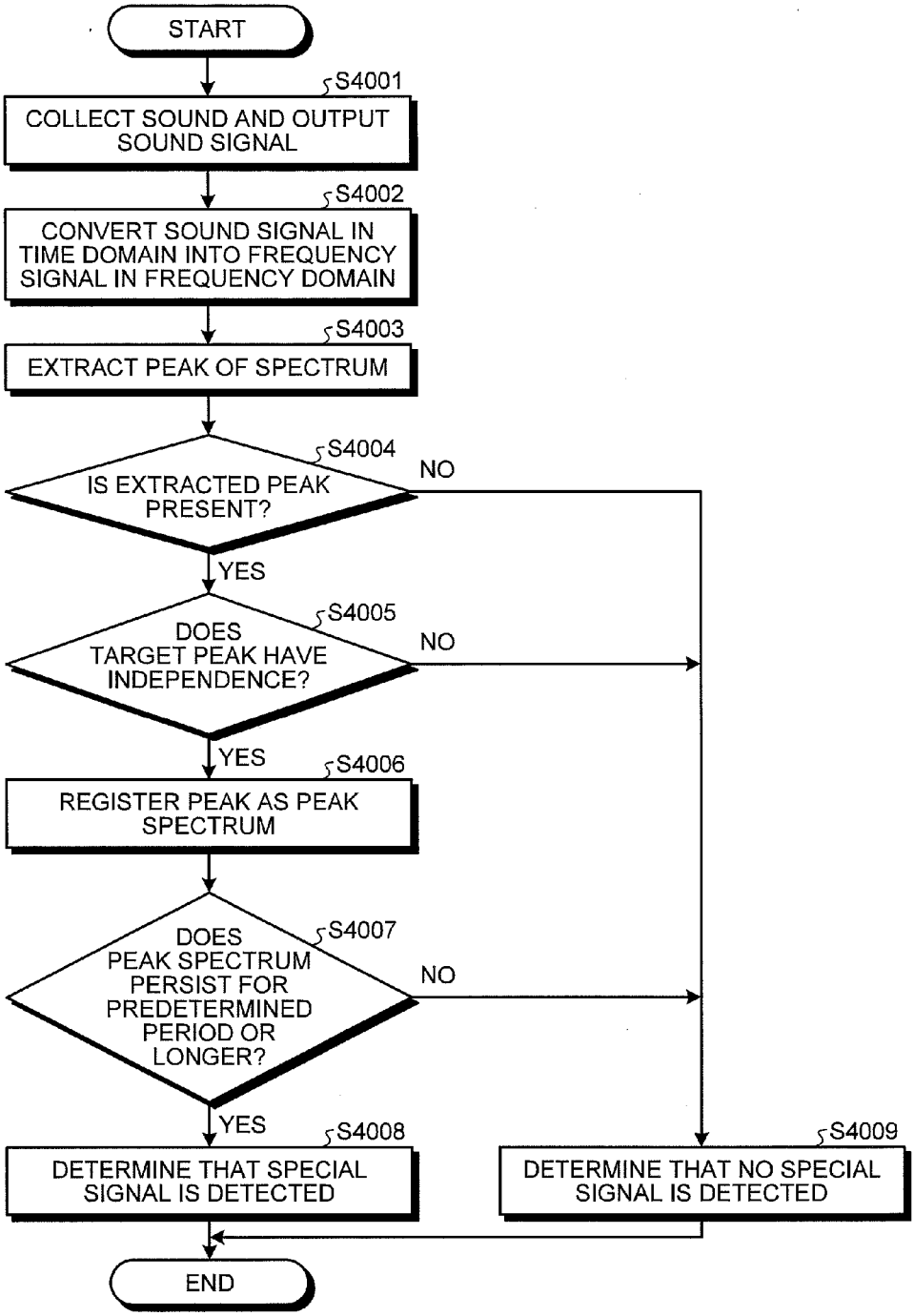
FIG. 9 is a flowchart of an operation of the special-signal detecting device according to the second embodiment.

The following describes an operation of the special-signal detecting device 300. FIG. 9 is a flowchart of an operation of the special-signal detecting device 300. Because processing at Step S4001 to Step S4005 and Step S4008 to Step S4009 is substantially the same as the processing at Step S1001 to Step S1005 and Step S1006 to Step S1007 described with reference to FIG. 2, an explanation thereof will be omitted. The following describes processing at Step S4006 and Step S4007 in detail.

If a peak spectrum is determined to have independence at Step S4005, the peak spectrum determining unit 306 determines the peak spectrum to be a peak spectrum candidate caused by a special signal, and registers the peak spectrum in a memory (Step S4006).

The persistence determining unit 307 determines whether or not the peak spectrum registered at Step S4006 persists for the predetermined period or longer (Step S4007). If the result of persistence determination indicates that the peak spectrum persists for the predetermined period or longer, the special-signal detecting unit 305 determines the persisting peak spectrum to be caused by a special signal (Step S4008). By contrast, if the result of persistence determination indicates that the peak spectrum does not persist for the predetermined period or longer, the special-signal detecting unit 305 determines that no special signal is detected yet (Step S4009).

As described above, the special-signal detecting device 300 according to the second embodiment determines whether a peak spectrum determined to maintain a frequency interval of equal to or larger than the predetermined value persists for the predetermined period or longer. Thus, the special-signal detecting device 300 determines whether the peak spectrum is caused by a special signal, thereby detecting a special signal. This can prevent unexpected noise from being erroneously detected as a special signal.

Figure 10:
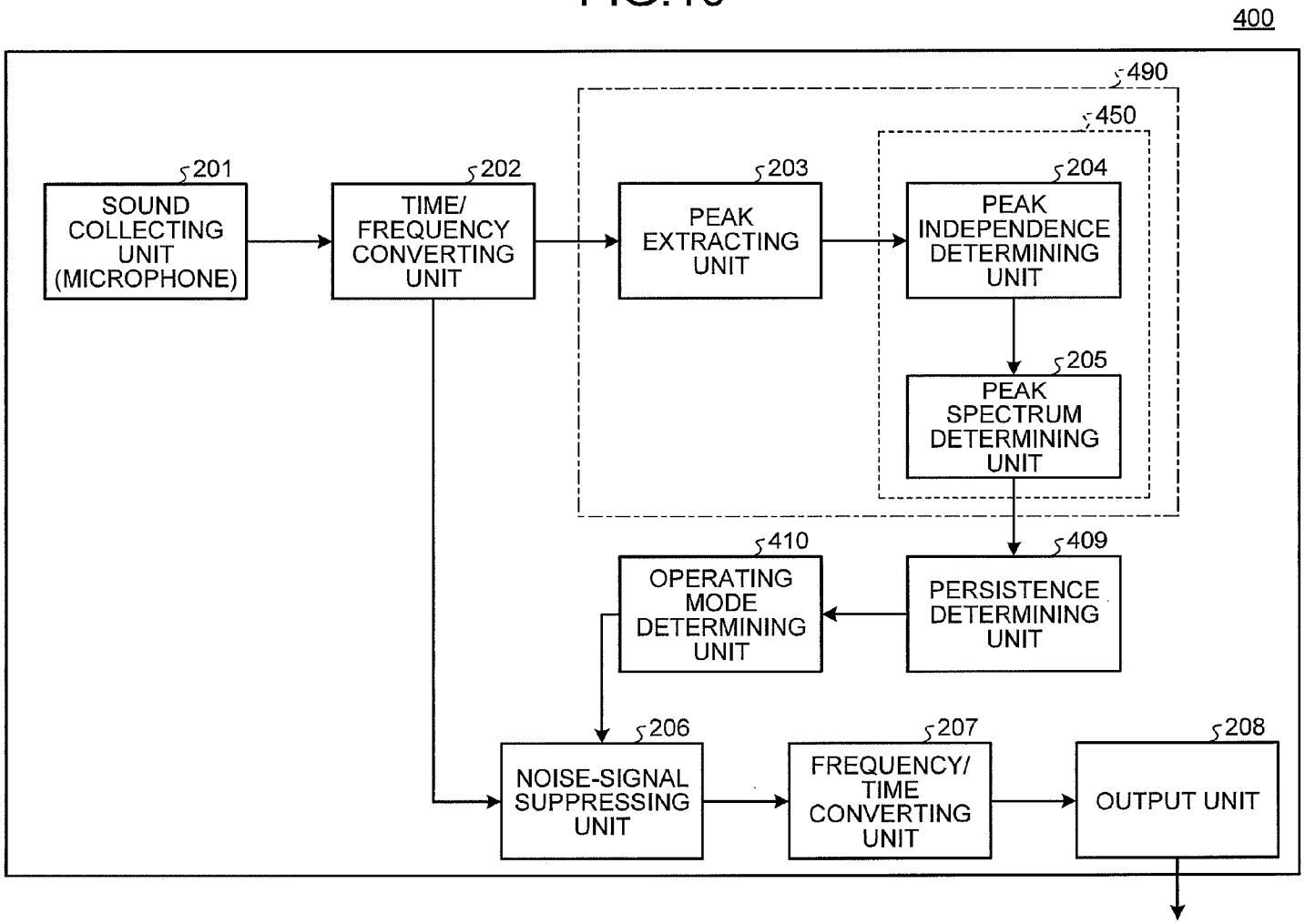
FIG. 10 is a block diagram of the configuration of a noise-signal suppressing device according to the second embodiment.

The following describes a noise-signal suppressing device further having the persistence determination function explained above. FIG. 10 is a block diagram of the configuration of a noise-signal suppressing device 400 according to the second embodiment.

The noise-signal suppressing device 400 includes a sound collecting unit 201, a time/frequency converting unit 202, a peak extracting unit 203, a peak independence determining unit 204, a peak spectrum determining unit 205, a noise-signal suppressing unit 206, a frequency/time converting unit 207, an output unit 208, a persistence determining unit 409, and an operating mode determining unit 410.

The persistence determining unit 409 determines the persistence of a peak spectrum extracted by the peak spectrum determining unit 205. In other words, the persistence determining unit 409 determines whether the peak spectrum registered as a peak spectrum having independence by the peak spectrum determining unit 205 persists for a predetermined period. The persistence determining unit 409 outputs the determination result to the operating mode determining unit 410.

Based on the determination result received from the persistence determining unit 409, the operating mode determining unit 410 determines an operating mode relating to suppression of special noise. The operating mode determining unit 410 has two operating modes of a suppression mode to suppress special noise and a normal mode not to suppress special noise. Based on the determination result received from the persistence determining unit 409, the operating mode determining unit 410 switches the mode. In accordance with the operating mode determined by the operating mode determining unit 410, the noise-signal suppressing unit 206 performs suppression processing of special noise.

The peak extracting unit 203, the peak independence determining unit 204, and the peak spectrum determining unit 205 are collectively referred to as an independent peak spectrum extracting unit 490. The independent peak spectrum extracting unit 490 extracts a peak spectrum having independence from the frequency signals having been subjected to frequency conversion.

The peak independence determining unit 204 and the peak spectrum determining unit 205 may be collectively referred to as a second peak extracting unit 450. The peak extracting unit 203 may be specifically referred to as a first peak extracting unit 203. The second peak extracting unit 450 extracts a peak spectrum maintaining a frequency interval of equal to or larger than a predetermined value with respect to a peak spectrum adjacent thereto from the peak spectra extracted by the first peak extracting unit 203 as a peak spectrum having independence.

Figure 11:
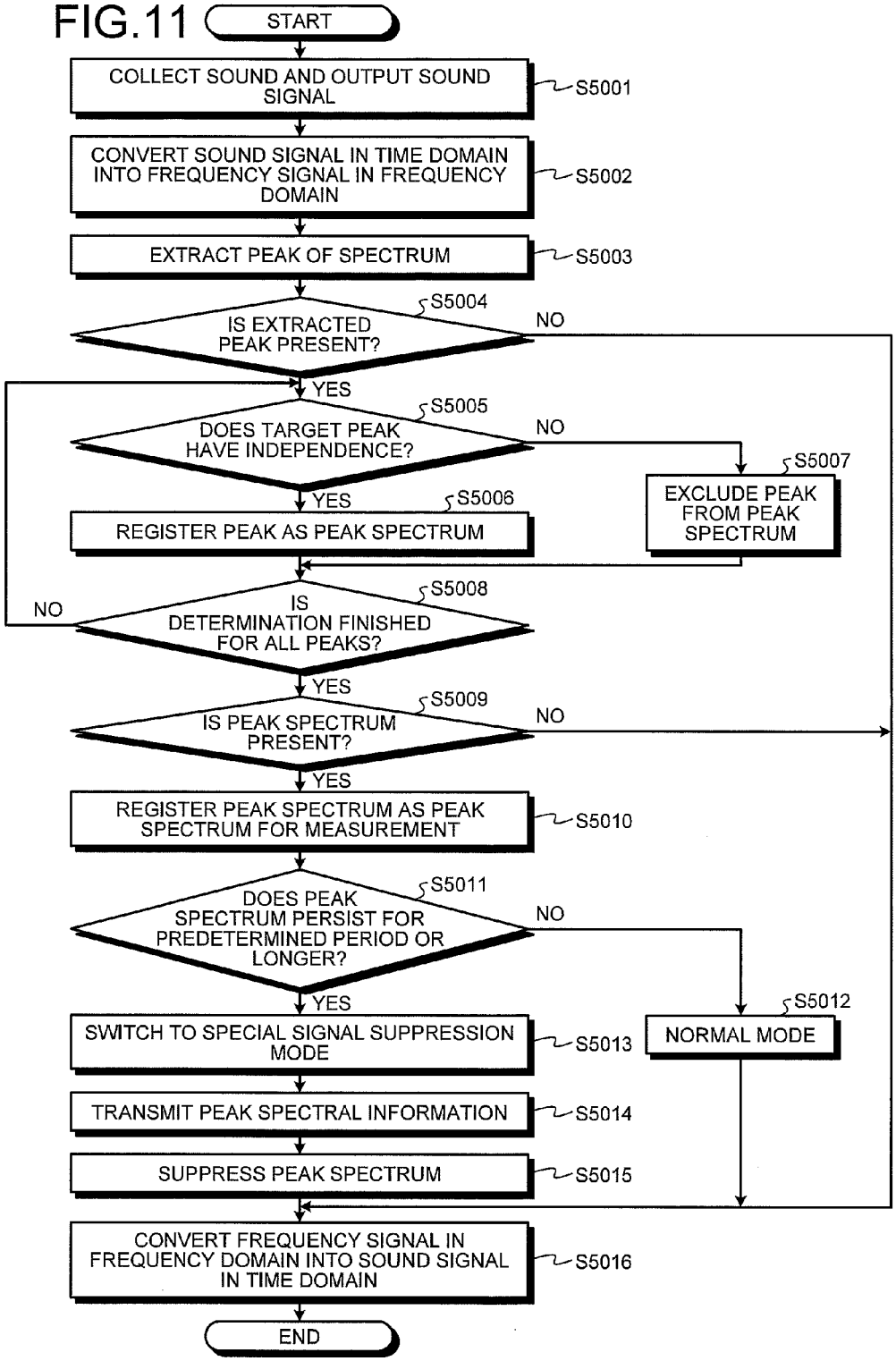
FIG. 11 is a flowchart of an operation of the noise-signal suppressing device according to the second embodiment.

The following describes an operation of the noise-signal suppressing device 400. FIG. 11 is a flowchart of an operation of the noise-signal suppressing device 400. Because processing at Step S5001 to Step S5009 is substantially the same as the processing at Step S2001 to Step S2009 in FIG. 4, an explanation thereof will be omitted. The following describes processing from Step S5010 in detail.

The peak spectrum determining unit 205 registers a peak spectrum determined to be independent by the peak independence determining unit 204 as a peak spectrum for measurement of persistence (Step S5010).

The persistence determining unit 409 determines whether the peak spectrum registered at Step S5010 persists for the predetermined period or longer (Step S5011). The result of determination made at Step S5011 is transmitted to the operating mode determining unit 410.

If the result of determination made at Step S5011 indicates that the peak spectrum for measurement does not persist for the predetermined period or longer, the operating mode determining unit 410 sets the operating mode into the normal mode not to suppress special noise (Step S5012). By contrast, if the result of determination made at Step S5011 indicates that the peak spectrum for measurement persists for the predetermined period or longer, the operating mode determining unit 410 switches the operating mode into the suppression mode to suppress special noise (Step S5013). In the suppression mode, the operating mode determining unit 410 transmits information on the independent peak spectrum registered at Step S5006 to the noise-signal suppressing unit 206 (Step S5014).

The noise-signal suppressing unit 206 uses the information on the peak spectrum to be suppressed as a special noise signal, of which information is transmitted from the operating mode determining unit 410, for the peak spectrum extracted by the time/frequency converting unit 202, thereby performing noise suppression processing (Step S5015).

A frequency signal having been subjected to the noise suppression processing in the suppression mode or a frequency signal not having been subjected to the noise suppression processing in the normal mode is reconverted into sound signal in the time domain by the frequency/time converting unit 207 (Step S5016).

Figure 12:
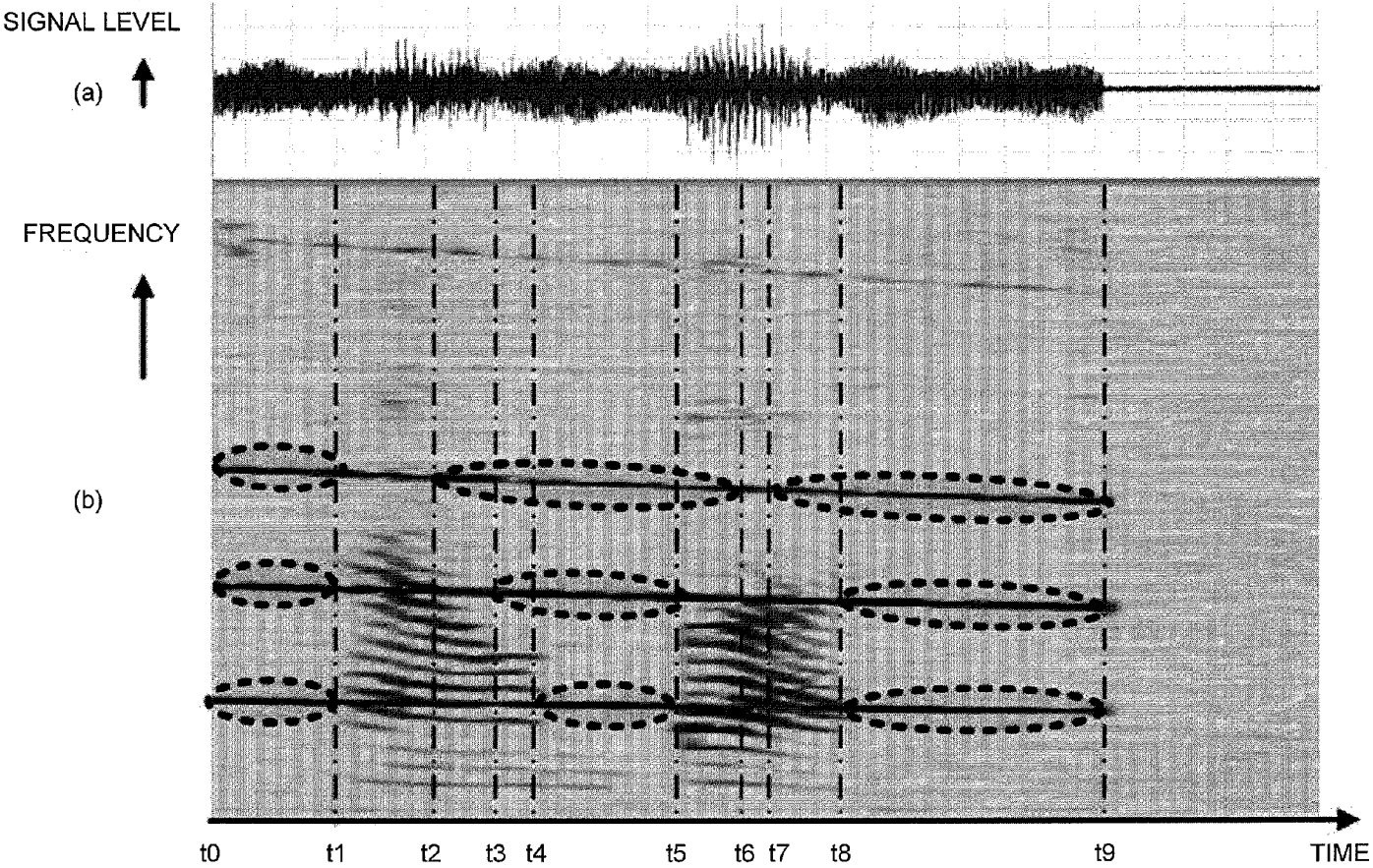
FIG. 12 is a chart of a signal level and a spectrogram waveform illustrating a case in which a siren sound and speech of a human are simultaneously collected.

(a) of FIG. 12 is a time waveform chart of an amplitude level of an input signal in a case in which speech of a human and a siren sound are simultaneously collected, and (b) of FIG. 12 illustrates a spectrogram waveform of the input signal and is arranged side by side with (a) of FIG. 12. In (b) of FIG. 12, the ordinate represents the frequency, the shading indicates the intensity of the spectrum, and the abscissa represents the time shift.

As illustrated in (b) of FIG. 12, a siren sound having a harmonic structure is detected in the section from time t0 to t9; and speech is detected in the sections from t1 to t4 and from t5 to t8. The portions surrounded by the dotted ellipses in (b) of FIG. 12 indicate peak spectral regions determined as independent peak spectra by the peak independence determining unit 204.

Figure 13:
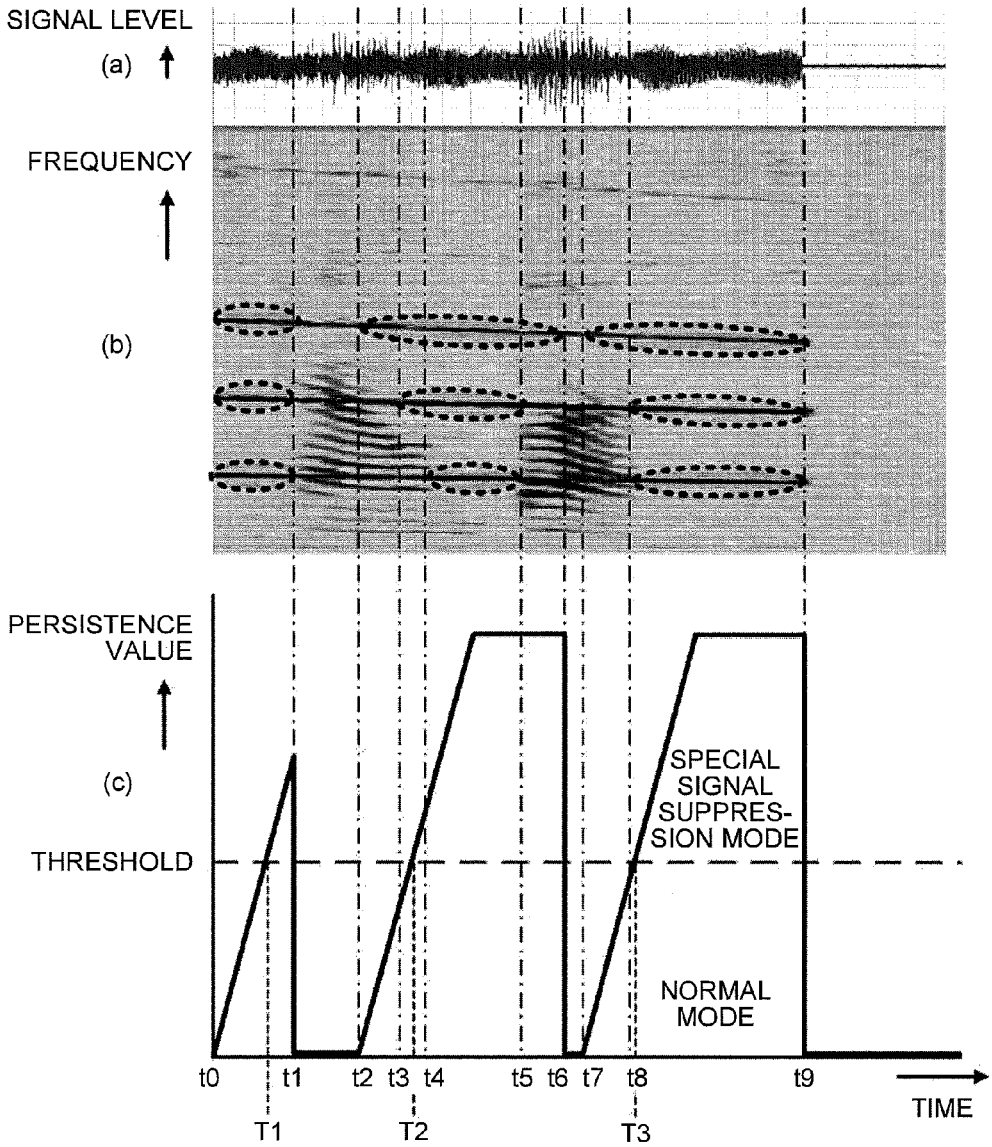
FIG. 13 is a diagram for explaining the timing for switching a normal mode and a special signal suppression mode in the noise-signal suppressing device according to the second embodiment.

The following describes an operation of the persistence determining unit 409 and an operation of the operating mode determining unit 410 in the state illustrated in (a) and (b) of FIG. 12 with reference to FIG. 13. (c) of FIG. 13 is a diagram for explaining the persistence of the peak spectra and the switching of the operating modes, and is arranged side by side with (a) and (b) of FIG. 13.

In the section from t0 to t1, an independent peak spectrum continues to be detected. At time T1, the persistence determining unit 409 determines that the peak spectrum persists for the predetermined period or longer and issues an operating mode switching instruction to the operating mode determining unit 410. The operating mode determining unit 410 receives the operating mode switching instruction and switches the operating mode from the normal mode to the suppression mode.

After the timing t1 at which the speech is collected, the peak extracting unit 203 extracts peaks. The peak independence determining unit 204, however, determines that each peak spectrum is not independent until the timing t2. The persistence determining unit 409 determines that the peak spectrum does not persist at the timing t1 and issues an operating mode switching instruction to return to the normal mode to the operating mode determining unit 410. Based on the operating mode switching instruction, the operating mode determining unit 410 returns the operating mode from the suppression mode to the normal mode.

This processing extracts independent peak spectra in the sections from t2 to t6 and from t7 to t9; and the persistence determining unit 409 determines that each peak spectrum persists. In the same manner as the timing T1, the persistence determining unit 409 issues an operating mode switching instruction to switch the operating mode from the normal mode to the suppression mode to the operating mode determining unit 410 at the timings T2 and T3, when the persistence value exceeds a threshold. Thus, the operating mode is switched from the normal mode to the suppression mode. At the timings t6 and t9, the persistence determining unit 409 issues an operating mode switching instruction to switch the operating mode from the suppression mode to the normal mode to the operating mode determining unit 410. Thus, the operating mode is switched from the suppression mode to the normal mode.

As described above, the noise-signal suppressing device 400 according to the second embodiment determines whether a peak spectrum determined to maintain a frequency interval of equal to or larger than the predetermined value persists for the predetermined period or longer. Thus, the noise-signal suppressing device 400 determines whether the peak spectrum is caused by a special signal. If a peak spectrum having independence persists for the predetermined period or longer, the noise-signal suppressing device 400 suppresses the peak spectrum component. This configuration can prevent unexpected speech, which is not special noise such as a siren sound, from being erroneously suppressed.

In the description above, the peak independence determining unit 204 determines a peak spectrum to be independent because it is separated from another peak spectrum by the predetermined frequency or more, and the peak spectrum determining unit 205 registers the peak spectrum as a peak spectrum for persistence measurement. The present embodiment is not limited thereto. In the case in which the peak independence determining unit 204 determines that a plurality of peak spectra are independent, the peak spectrum determining unit 205 may register a part of the peak spectra as the peak spectrum for persistence measurement.

Figure 14:
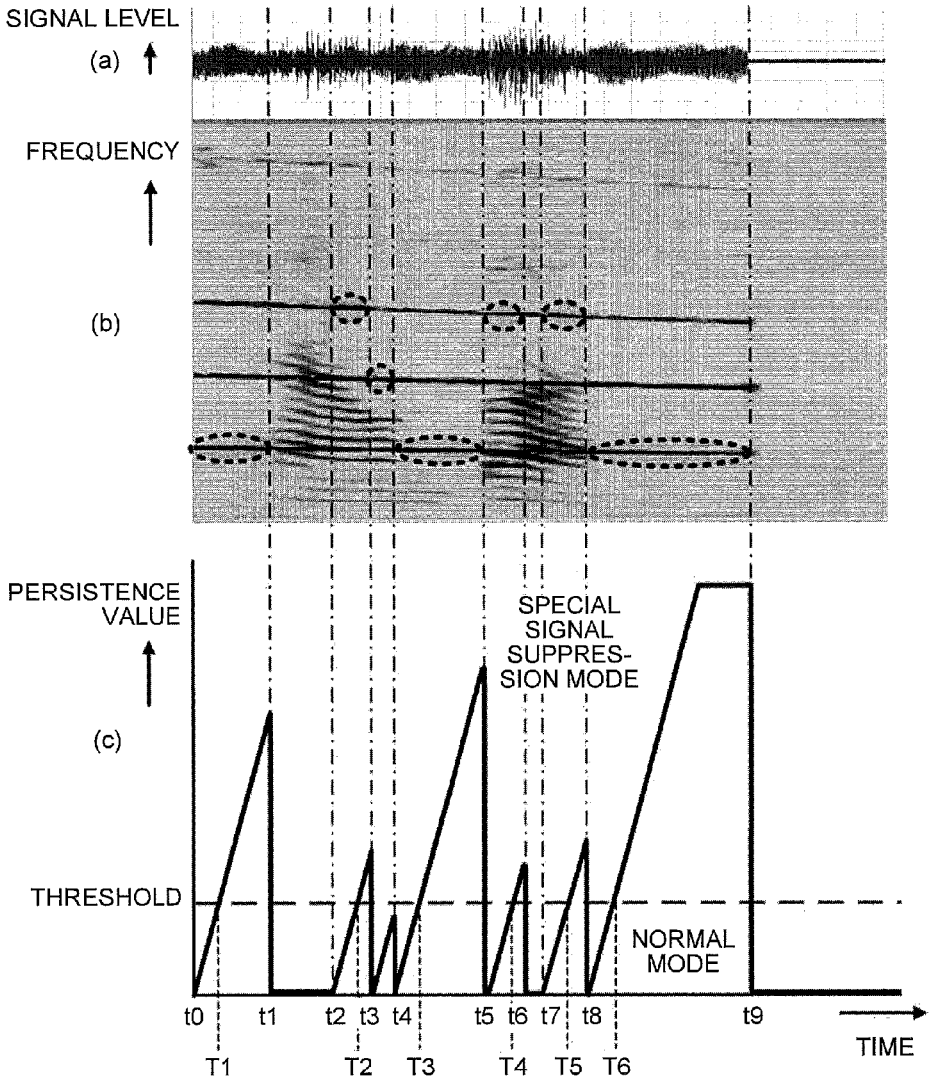
FIG. 14 is a diagram for explaining the timing for switching the normal mode and the special signal suppression mode in another noise-signal suppressing device according to the second embodiment.

FIG. 14 is a diagram for explaining, when persistence is determined using one peak spectrum having the lowest frequency out of the peak spectra determined to have independence as a peak spectrum for persistence measurement, the persistence of the peak spectrum and the switching of the operating modes.

Peak spectra in the portions surrounded by the dotted ellipses in (b) of FIG. 14 are extracted by the peak spectrum determining unit 205 as peak spectra for persistence measurement. Because one peak spectrum is focused on in the determination of persistence illustrated in (b) of FIG. 14, the threshold for switching the operating modes, that is, a time interval until the operating mode is switched into the suppression mode is set shorter than the case in FIG. 13.

As illustrated in (b) and (c) of FIG. 14, peak spectra having independence are detected in the sections from t0 to t1, from t2 to t6, and from t7 to t9. Because the peak spectrum to be focused on is changed at the timings t3, t4, t5, and t8, the persistence determining unit 409 resets the count of persistence. In the case in FIG. 14, the section, in which the operating mode determining unit 410 sets the operating mode into the suppression mode and the noise-signal suppressing unit 206 performs suppression processing on special noise, corresponds to the sections from T1 to t1, from T2 to t3, from T3 to t5, from T4 to t6, from T5 to t8, and from T6 to t9.

The processing method illustrated in FIG. 14 makes the section, in which special noise is detected and suppressed, shorter than that of the processing method illustrated in FIG. 13. Because the persistence can be determined by focusing on one peak spectrum, it is possible to detect and suppress the special noise with a smaller amount of operation.

Obviously, the specific detection method described in the noise-signal suppressing device 400 is applicable to the special-signal detecting device 300.

Third Embodiment

The special noise suppressing method explained with reference to FIG. 13 performs persistence determination processing on a plurality of peak spectra. This special noise suppressing method increases the processing load of the device but can appropriately detect the presence of special noise so as to perform noise suppression processing. By contrast, the special noise suppressing method explained with reference to FIG. 14 determinates the persistence by focusing on one peak spectrum. Thus, the special noise suppressing method can reduce the processing load but increases the number of sections in which a special noise signal fails to be suppressed.

To address this, a noise-signal suppressing device according to a third embodiment reduces the processing load and appropriately detects the presence of a special noise signal so as to perform noise suppression processing. The noise-signal suppressing device according to the third embodiment is described below in more detail with reference to the accompanying drawings. An explanation of the components already described in the first and second embodiments will be partially omitted for clarification.

Figure 15:
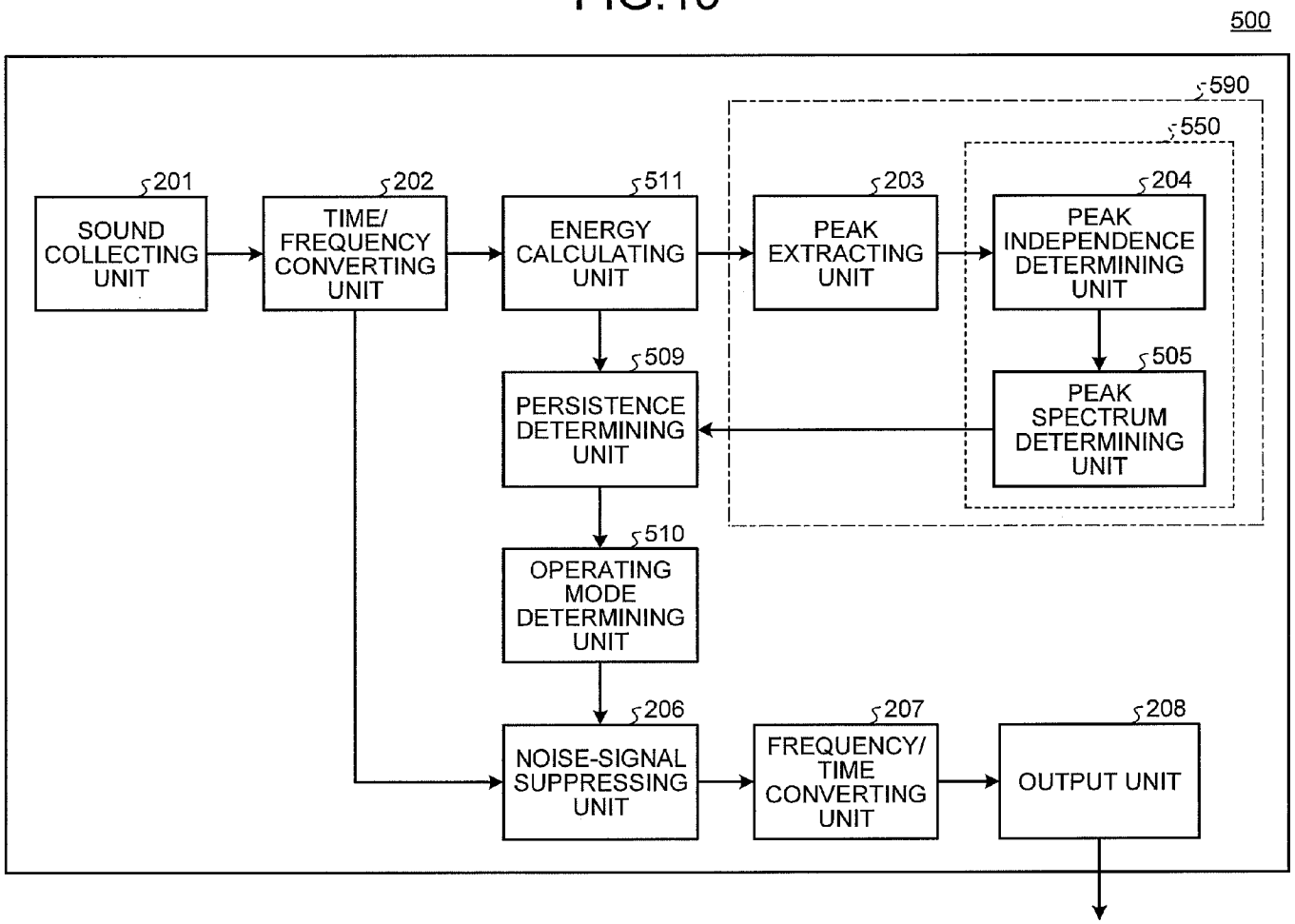
FIG. 15 is a block diagram of the configuration of a noise-signal suppressing device according to a third embodiment.

FIG. 15 is a block diagram of the configuration of a noise-signal suppressing device 500 according to the third embodiment. The noise-signal suppressing device 500 includes a sound collecting unit 201, a time/frequency converting unit 202, a peak extracting unit 203, a peak independence determining unit 204, a noise-signal suppressing unit 206, a frequency/time converting unit 207, an output unit 208, a peak spectrum determining unit 505, a persistence determining unit 509, an operating mode determining unit 510, and an energy calculating unit 511.

The energy calculating unit 511 calculates an energy amount (a sound pressure level) of a sample group formed of a plurality of samples serving as a unit of processing for a frequency signal received from the time/frequency converting unit 202. The energy calculating unit 511 determines whether the calculated energy amount exceeds a predetermined reference energy amount. The determination result is output into the persistence determining unit 509.

The peak spectrum determining unit 505 determines a peak spectrum having the lowest frequency out of a plurality of peak spectra determined to have independence by the peak independence determining unit 204 as a peak spectrum for persistence measurement. The peak spectrum determining unit 505 transmits the determined peak spectrum to the persistence determining unit 509.

The persistence determining unit 509 determines whether the peak spectrum persists based on the result of energy calculation (result of energy measurement) performed by the energy calculating unit 511 and based on the determination of persistence of the peak spectrum for measurement transmitted from the peak spectrum determining unit 505.

Specifically, the persistence determining unit 509 increases and decreases a value referred to as a persistence point stored in an internal counter based on the result of energy calculation performed by the energy calculating unit 511 and based on the determination of persistence of the peak spectrum for measurement transmitted from the peak spectrum determining unit 505. The persistence point is a set value relating to the determination of persistence for determining whether or not to perform suppression processing on a special noise component. The value of the persistence point measured and managed by the persistence determining unit 509 is transmitted to the operating mode determining unit 510.

The operating mode determining unit 510 compares the value of the persistence point received from the persistence determining unit 509 with a point threshold serving as a reference, thereby switching between the special signal suppression mode and the normal mode. If the value of the persistence point exceeds the threshold, the operating mode determining unit 510 sets the operating mode to the special signal suppression mode. The operating mode determining unit 510 then outputs information on the peak spectrum determined to be an independent peak spectrum and extracted by the peak independence determining unit 204 to the noise-signal suppressing unit 206. In accordance with the suppression operating mode specified by the operating mode determining unit 510, the noise-signal suppressing unit 206 performs special-noise suppression processing so as to suppress a target peak spectrum signal based on the received information on the peak spectrum.

The peak extracting unit 203, the peak independence determining unit 204, and the peak spectrum determining unit 505 are collectively referred to as an independent peak spectrum extracting unit 590. The independent peak spectrum extracting unit 590 extracts a peak spectrum having independence from the frequency signals having been subjected to frequency conversion.

The peak independence determining unit 204 and the peak spectrum determining unit 505 may be collectively referred to as a second peak extracting unit 550. The peak extracting unit 203 may be specifically referred to as a first peak extracting unit 203. The second peak extracting unit 550 extracts a peak spectrum, maintaining a frequency interval of equal to or larger than a predetermined value with respect to a peak spectrum adjacent thereto from the peak spectra extracted by the first peak extracting unit 203, as a peak spectrum having independence.

The persistence determining unit 509 manages the set value increased when the independent peak spectrum extracted by the independent peak spectrum extracting unit 590 persists and decreased when the independent peak spectrum does not persist. The persistence determining unit 509 may be referred to as a set value management unit 509. The set value management unit 509 increases the set value when the independent peak spectrum extracted by the independent peak spectrum extracting unit 590 persists and decreases the set value when the independent peak spectrum does not persist. The operating mode determining unit 510 determines whether to or not to cause the noise-signal suppressing unit 206 to suppress a noise signal based on whether or not the set value managed by the set value management unit 509 exceeds the predetermined threshold.

Figure 16:
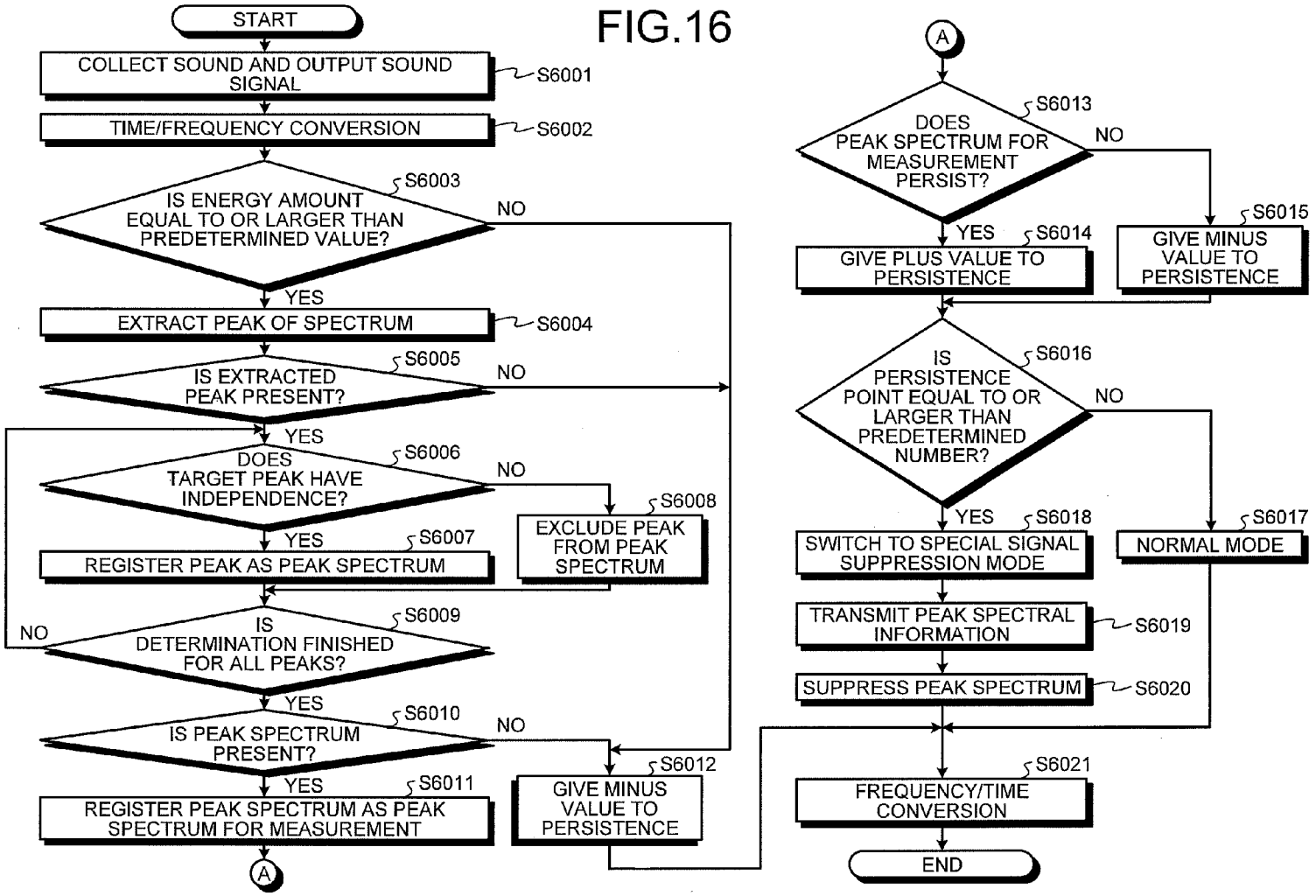
FIG. 16 is a flowchart of an operation of the noise-signal suppressing device according to the third embodiment.

The following describes an operation of the noise-signal suppressing device 500. FIG. 16 is a flowchart of an operation of the noise-signal suppressing device 500. Because processings at Step S6001 to Step S6002, Step S6006 to Step S6009, and Step S6017 to Step S6021 are substantially the same as the processings at Step S5001 to Step S5002, Step S5005 to Step S5008, and Step S5012 to Step S5016 in FIG. 11, explanations thereof will be omitted.

The following describes processing at Step S6003 to Step S6005. The energy calculating unit 511 calculates an energy amount (a sound pressure level) of a sample group formed of a plurality of samples serving as a unit of processing for a frequency signal received from the time/frequency converting unit 202. The energy calculating unit 511 determines whether the energy amount exceeds a predetermined energy amount (Step S6003). The processing at Step S6003 is performed to determine whether a target sound signal in the voice coding process is affected by noise based on the energy of the input signal. The determination result is transmitted to the persistence determining unit 509. If the result of determination made at Step S6003 indicates that the energy amount of the input signal is smaller than a reference value, the persistence determining unit 509 gives a minus value to the persistence point (Step S6012).

Special noise included in the input signal, that is, a noise signal of a warning sound or the like having a low sound pressure level slightly affects the sound signal in the voice coding, and a sufficient speech quality is maintained. Thus, the suppression processing simply needs to be performed only when an excessively large warning sound is present. In the present embodiment, the energy calculating unit 511 determines whether the sound pressure level of the input signal is equal to or higher than 80 dB. If the sound pressure level is equal to or higher than 80 dB, suppression processing of the special noise signal is performed (there is a case in which no suppression processing may possibly be performed in the end). If the sound pressure level is lower than 80 dB, a minus value is given to the set value relating to the determination of persistence for determining whether to perform the suppression processing on the special noise component. The energy calculating unit 511 may calculate the energy amount either before or after the frequency conversion. A sound pressure level of 80 dB, which is set as the reference value, is equivalent to the level which is detected under an elevated railway track, the level of factory noise, and the like and requires the noise suppression processing in the voice coding.

The peak extracting unit 203 extracts peaks having peak characteristics from the received frequency signals (Step S6004). Because the specific extracting method is already described, the explanation thereof will be omitted.

The peak independence determining unit 204 determines whether a peak spectrum is extracted by the peak extracting unit 203 and transmits the determination result to the persistence determining unit 509 (Step S6005). If the result of determination made by the peak independence determining unit 204 indicates that no spectrum serving as a peak is present, that is, no warning sound is present or a warning sound having a sufficiently low energy component is present, the persistence determining unit 509 gives a minus value to the persistence point (Step S6012).

The following describes processing at Step S6010 to Step S6016. The peak spectrum determining unit 505 determines whether a peak spectrum having independence is extracted and registered based on the peak determination made by the peak independence determining unit 204 (Step S6010). If the determination result indicates that no peak spectrum having independence is registered, the persistence determining unit 509 gives a minus value to the persistence point (Step S6012).

By contrast, if the result of determination made at Step S6010 indicates that a peak spectrum having independence is registered, the peak spectrum determining unit 505 selects and registers a peak spectrum for persistence measurement from the registered peak spectrum (Step S6011). In the case in which a plurality of peak spectra having independence are extracted, the peak spectrum determining unit 505 selects the lowest-band peak spectrum out of the peak spectra and registers the lowest-band peak spectrum as a peak spectrum for persistence measurement.

In the state illustrated in FIG. 6, for example, the peak spectrum determining unit 505 determines the peak spectrum P1 having the lowest frequency out of the peak spectra P1 to P3 determined to have independence by the peak independence determining unit 204 as a peak spectrum for persistence measurement. In the state illustrated in FIG. 7, the peak spectrum determining unit 505 automatically determines the peak spectrum Q7 determined to have independence by the peak independence determining unit 204 as a peak spectrum for persistence measurement.

The persistence determining unit 509 determines whether the peak spectrum for measurement selected at Step S6011 persists (Step S6013). In other words, the persistence determining unit 509 determines whether the peak spectrum selected as the lowest-band peak spectrum continues to be selected as the lower-band peak spectrum along with time.

Specifically, the persistence determining unit 509 uses the lowest-band peak spectrum registered for persistence measurement and a previously registered lowest-band peak spectrum and determines whether temporal persistence is present therebetween based on peak spectral information obtained by two sets of frequency conversion temporally adjacent to each other. Thus, the persistence determining unit 509 observes the temporal persistence of the special noise.

While most of the siren sounds and high-pitched engine sounds have frequency components varying with time, the frequency shift width is limited in an extremely short time. Because the frequency conversion duration is set from several tens of milliseconds to several hundreds of milliseconds as described above, an increase in time resolution leads to a decrease in the frequency shift. The persistence determining unit 509 provides a predetermined allowable frequency range corresponding to the frequency conversion duration to the lowest-band peak spectrum. The persistence determining unit 509 determines whether the next lowest-band peak spectrum is included in the range, thereby determining the persistence. The allowable range is a bandwidth including spectra before and after the selected spectrum obtained by frequency conversion, for example.

If the result of determination made at Step S6013 indicates that the peak spectrum persists, the persistence determining unit 509 gives a plus value to the persistence point (Step S6014). By contrast, if it is determined that the peak spectrum does not persist, the persistence determining unit 509 gives a minus value to the persistence point (Step S6015). Every time the persistence point is updated, it is transmitted to the operating mode determining unit 510.

Specifically, the persistence determining unit 509 determines whether or not a bandwidth, including spectra before and after the previously registered lowest-band peak spectrum, contains the currently registered lowest-band peak spectrum. If the determination result indicates that the difference in frequency between the currently registered lowest-band peak spectrum and the previously registered lowest-band peak spectrum falls within the predetermined range, the persistence determining unit 509 determines that the peak spectrum persists. The persistence determining unit 509 gives a plus value indicating that the peak spectrum persists to the persistence point. By contrast, if the currently registered lowest-band peak spectrum is not included in the predetermined range, the persistence determining unit 509 determines that the peak spectrum does not persist. The persistence determining unit 509 gives a minus value indicating that the peak spectrum does not persist to the persistence point. Determining the persistence in this manner can eliminate the influence of a peak spectrum erroneously detected because of an unexpected noise component.

The operating mode determining unit 510 compares the current value of the persistence point that is transmitted with a threshold for switching the operating modes, thereby determining whether the persistence point is equal to or larger than a predetermined number (Step S6016). Based on the determination result, the operating mode determining unit 510 sets the operating mode to the suppression mode or to the normal mode.

Figure 17:
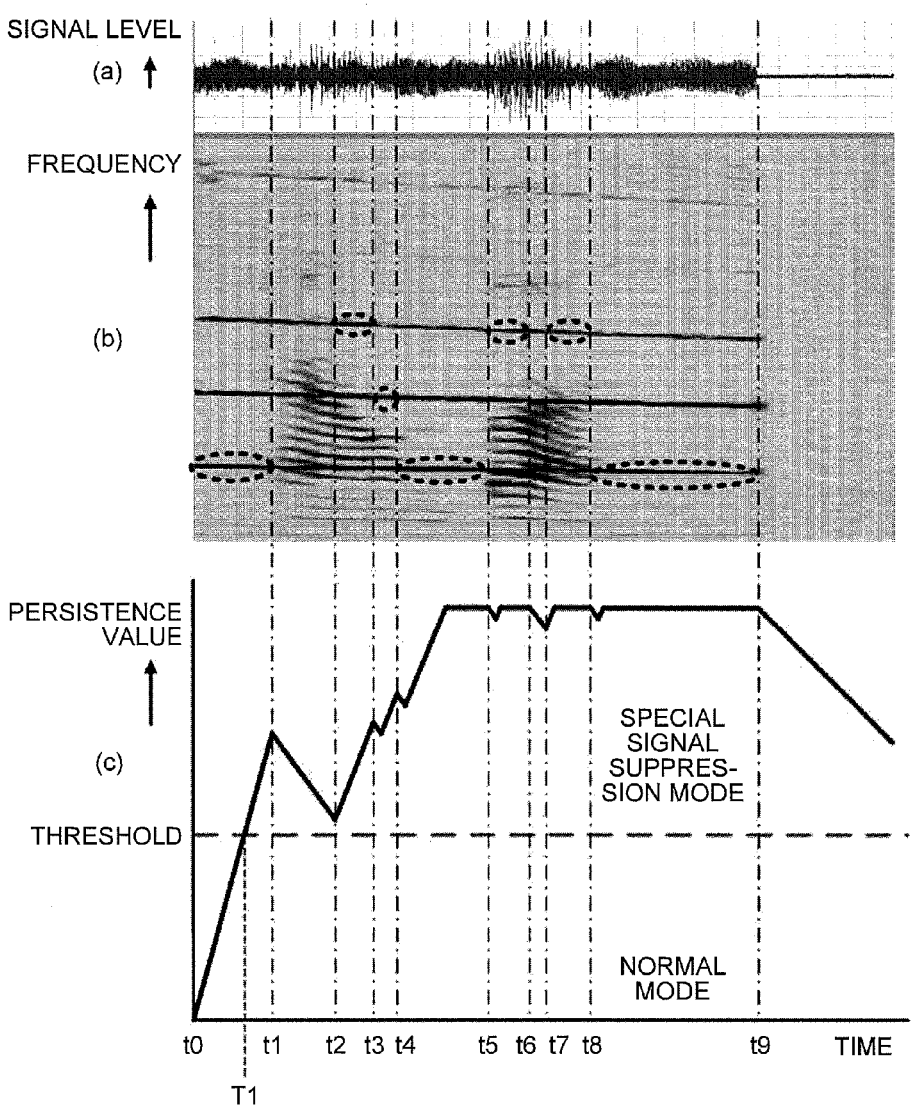
FIG. 17 is a diagram for explaining the timing for switching the normal mode and the special signal suppression mode in the noise-signal suppressing device according to the third embodiment.

The following describes changes in the persistence point along with time in the noise-signal suppressing device 500 with reference to FIG. 17 and the flowchart illustrated in FIG. 16. FIG. 17 is a diagram for explaining the persistence of the peak spectrum and the switching of the operating modes. (c) of FIG. 17 illustrates the persistence point value that determines a transition to the suppression operating mode.

As illustrated in FIG. 17, a plus value is given to the persistence point in accordance with Step S6014 in the sections from t0 to t1, from t2 to t6, and from t7 to t9. By contrast, a minus value is given to the persistence point in accordance with Step S6012 in the sections from t1 to t2, from t6 to t7, and after t9. Because the peak spectrum for persistence measurement is changed at the timings t3, t4, t5, and t8, a minus value is temporarily given in accordance with Step S6015.

As illustrated in FIG. 17, the persistence point has the upper limit, and the persistence determining unit 509 does not increase the persistence point more than the upper limit. In other words, before giving a plus value at Step S6014, the persistence determining unit 509 subsidiarily determines whether the persistence point already reaches the upper limit. If the persistence point already reaches the upper limit, the persistence determining unit 509 does not give the plus value. Similarly, before giving a minus value at Step S6015, the persistence determining unit 509 subsidiarily determines whether the persistence point already reaches 0, which is the lower limit. If the persistence point already reaches the lower limit of 0, the persistence determining unit 509 does not give the minus value.

Setting the upper limit and the lower limit for the persistence point in this manner can provide a certain retention time in a transition of the operating mode. This stabilizes the operating mode, thereby effectively reducing a feeling of strangeness caused by a rapid change in an output signal. Setting the upper limit in this manner can optimize the time from when a special signal disappears to when the operating mode returns to the normal mode.

As illustrated in FIG. 17, the persistence determination processing is performed focusing on one peak spectrum as a target, thereby decreasing the processing load. In a section in which a special signal is present, the special signal suppression mode is appropriately maintained, and the noise-signal suppressing unit 206 suppresses special noise caused by the special signal. This can achieve noise-signal suppression processing having the advantageous effects of both the processing illustrated in FIG. 13 and the processing illustrated in FIG. 14.

FIG. 18A illustrates an example in which a signal not subjected to special-noise suppression processing in a section of a siren sound including speech is input to a voice coding and decoding device, and the resultant output signal is indicated by a spectrogram. FIG. 18B illustrates an example in which a signal having been subjected to special-noise suppression processing in a section of a siren sound including speech is input to the voice coding and decoding device, and the resultant signal is indicated by a spectrogram. The voice coding and decoding device that performs voice coding and other processing on the received sound signal may be provided to the output unit 208 or an output destination of the output unit 208. The voice coding and decoding device (voice coding and decoding unit) may use various types of voice coding methods for the voice coding, including code-excited linear prediction (CELP) employed in mobile phones and vocoder employed in radios, for example.

As is clear from the comparison between FIG. 18A and FIG. 18B, performing no special-noise suppression processing reduces the articulation of the speech waveform because of an influence of siren sound components (thick lateral stripes). By contrast, performing special-noise suppression processing enables the stripe patterns of the speech waveform to be clearly observed. This is because a restoration effect is exerted on the sound signal component in the process of the voice coding and decoding.

As described above, the noise-signal suppressing device according to the third embodiment increases and decreases the set value relating to determination of persistence for determining whether or not to perform suppression processing of a special noise component, thereby switching the operating modes.

If a peak spectrum having independence is present in the noise-signal suppressing device, the persistence determining unit 509 registers the lowest-band peak spectrum used as a reference for determining a frequency range to observe temporal persistence, and then performs persistence determination processing. At this time, the persistence determining unit 509 separately records lowest-band peak spectral information previously registered as previously registered lowest-band peak spectral information. The persistence determining unit 509 determines whether the previously registered lowest-band peak spectral information and currently registered lowest-band peak spectral information are included in the predetermined frequency range, thereby determining the persistence. Based on the determination result, the persistence determining unit 509 gives a plus value or a minus value to the persistence point. If no peak spectrum is eventually registered in the determination of independence at the previous stage, it is assumed that no special noise is present. The persistence determining unit 509 gives a minus value to the persistence point serving as the set value relating to determination of persistence for determining whether to perform suppression processing of a special noise component.

The plus value or the minus value is given to the persistence point at every frequency conversion. When the persistence point reaches a predetermined number, the operating mode determining unit 510 determines that persistence, which is a characteristic of special noise, is detected and switches the operating mode to the special signal suppression mode so as to suppress a special noise signal. If the persistence point is smaller than the predetermined number, the operating mode determining unit 510 switches the operating mode to the normal mode so as not to suppress a special noise signal.

Introduction of the persistence point as a reference for observation of the persistence can reduce a time for detection of a warning sound and a time for non-detection of the warning sound after the warning sound stops compared with a pattern analysis carried out with a signal waveform on a temporal axis. This makes it possible to quickly suppress the warning sound. In addition, it is also possible to quickly determine that the warning sound stops (non-detection). This can save unnecessary suppression of a signal component, thereby maintaining the quality of the sound signal.

While a normal conversation may possibly be long in terms of a phrase, each word is output in a short time and has duration of approximately several hundreds of milliseconds. Duration of one word scarcely exceeds 500 milliseconds. A voice signal that contains a signal component having a harmonic structure and composed of a peak spectrum at a high sound pressure level is different from a special noise signal, such as a siren sound and an engine sound, in the persistence of each sound, which is an important factor, besides the frequency interval of the harmonic component. By allowing a frequency shift within a certain limited range and observing a shift of a characteristic frequency component (lowest-band peak spectrum) for a certain period of time, it is possible to grasp the presence of a special noise signal more accurately. From this point of view, the certain period of time simply needs to be set approximately one second. The certain period of time is set extremely shorter than a siren sound having long periodicity (five to ten seconds). This makes it possible to quickly detect the presence of the siren sound compared with the pattern analysis method in one period of a time signal and possible to take measures against the noise component.

The influence of the sound signal included in the special noise signal may possibly change and destabilize the spectrum to be extracted as the low-band peak spectrum each time. The noise-signal suppressing device according to the present embodiment observes the persistence point for a long term to determine the persistence, thereby maintaining the special signal suppression mode to suppress a special noise signal. Thus, the noise-signal suppressing device can suppress an extremely high peak spectrum, thereby maintaining the speech quality in a process of voice coding.

While the plus value and the minus value given to the persistence point are constant and the persistence point linearly changes in the description above, the present embodiment is not limited thereto. In FIG. 16, the minus value given based on the results of determination made at Step S6003, Step S6005, Step S6010, and Step S6013 may vary, for example. If no peak spectrum having an energy amount equal to or larger than the predetermined energy amount is detected at Step S6003, for example, the persistence determining unit 509 may determine that no special signal is present and may give a larger minus value. This configuration can hasten the return to the normal mode after t9 in FIG. 17.

Obviously, the special noise detecting function provided to the noise-signal suppressing device may be independently applicable to other uses as a special-signal detecting device.

Fourth Embodiment

Figure 19:
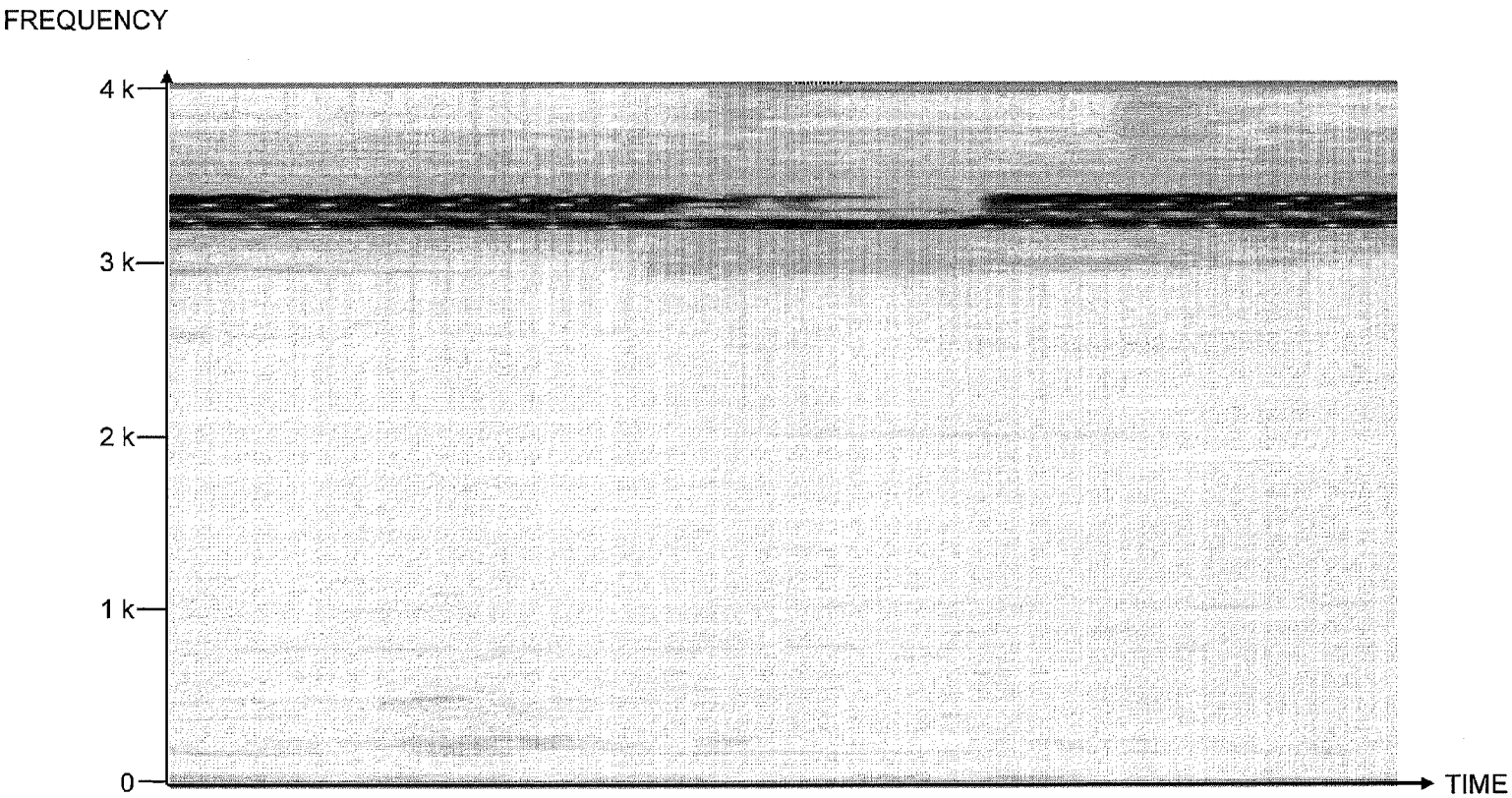

A notification sound having an extremely intense spectrum at a high band is output when the functions of a life-support system for a firefighter at a fire site deteriorate or when vital reactions of the firefighter himself/herself are reduced. FIG. 19 is a spectrogram chart of a notification sound output from a life-support system or the like in such emergency situations. FIG. 19 illustrates a spectrum group having intense energy at a high band. Similarly to a warning sound such as a siren sound, the influence of the intense component reduces the amount of information to be used for speech information in a process of a voice coding method employed in a communication device, thereby preventing a voice signal from being properly transmitted. In addition, the intense frequency component at the high band serves as a harsh sound, thereby rendering the voice sound inaudible.

A noise-signal suppressing device according to a fourth embodiment appropriately detects and suppresses a notification sound having special characteristics. The noise-signal suppressing device according to the fourth embodiment is described below in more detail with reference to the accompanying drawings.

Figure 20:
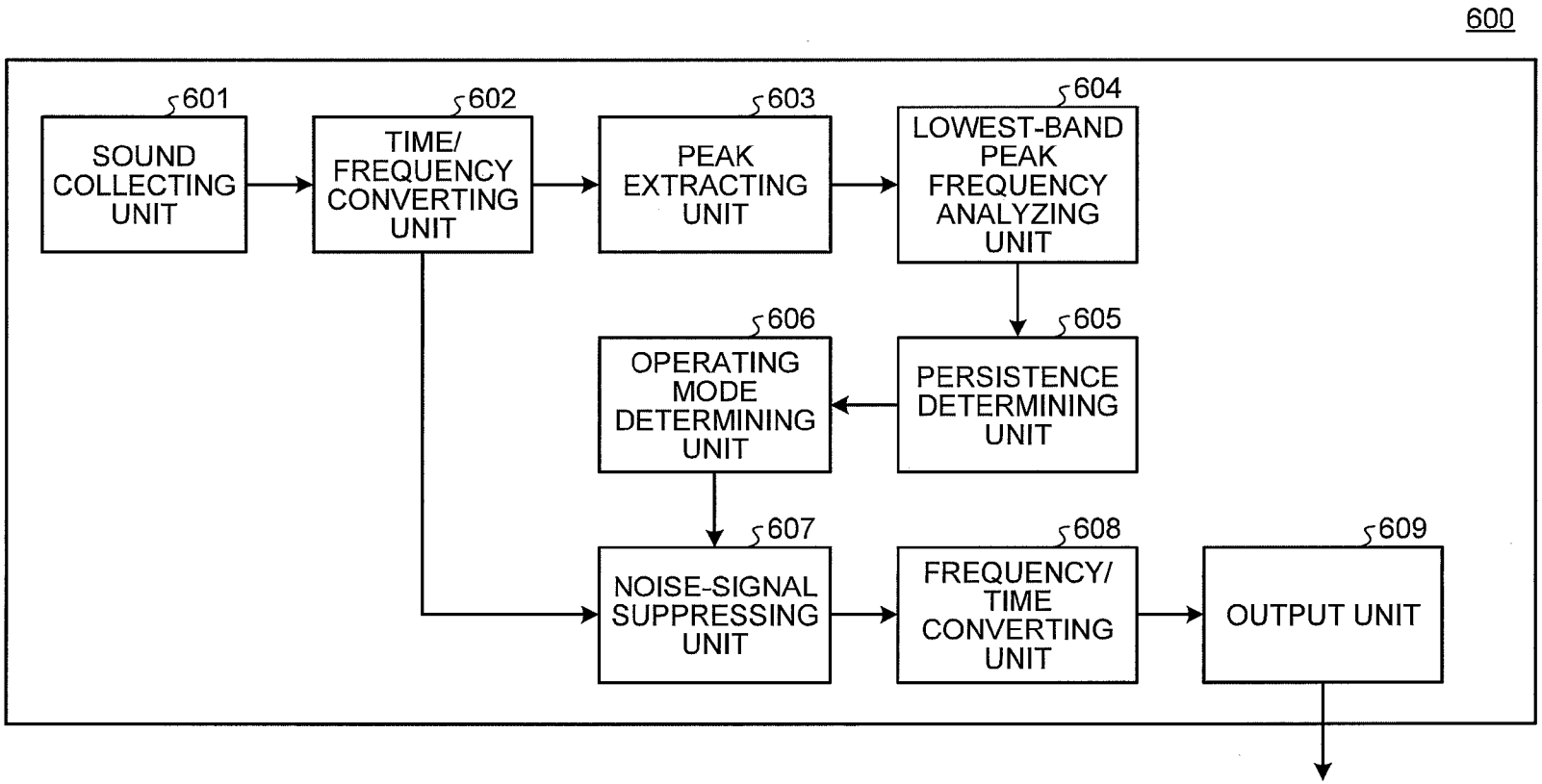
FIG. 20 is a block diagram of the configuration of a noise-signal suppressing device according to a fourth embodiment.

FIG. 20 is a block diagram of the configuration of a noise-signal suppressing device 600 according to the fourth embodiment. The noise-signal suppressing device 600 includes a sound collecting unit 601, a time/frequency converting unit 602, a peak extracting unit 603, a lowest-band peak frequency analyzing unit 604, a persistence determining unit 605, an operating mode determining unit 606, a noise-signal suppressing unit 607, a frequency/time converting unit 608, and an output unit 609.

The sound collecting unit 601 collects speech and noise. Ambient sound including a target sound collected by the sound collecting unit 601 is transmitted to the time/frequency converting unit 602 as a sound signal in the time domain. The sound collecting unit 601 (and a sound collecting unit 701, which will be described later) may function as an input unit that receives a sound signal. The input unit may receive a sound signal not from the sound collecting unit 601 (sound collecting unit 701) but from an external sound collecting device, for example.

The time/frequency converting unit 602 converts the sound signal in the time domain acquired by the sound collecting unit 601 into a frequency signal in the frequency domain. Because the time/frequency converting unit 602 simply needs to detect a notification sound, the frequency resolution thereof may be equal to or higher than 100 Hz.

The peak extracting unit 603 extracts a spectrum having an extremely high energy component from the spectrum signal converted into the frequency-domain signal by the time/frequency converting unit 602.

The lowest-band peak frequency analyzing unit 604 determines whether the lowest-band peak spectrum out of the peak spectra extracted by the peak extracting unit 603 is equal to or higher than a predetermined frequency. Specifically, the lowest-band peak frequency analyzing unit 604 determines whether the lowest-band peak spectrum is equal to or higher than 2 kHz.

The persistence determining unit 605 determines whether the lowest-band peak spectrum, which is determined to be equal to or higher than the predetermined frequency by the lowest-band peak frequency analyzing unit 604, persists. In other words, the persistence determining unit 605 determines whether the peak spectrum having a lowest-band frequency of equal to or higher than 2 kHz out of the extracted peak spectra is continuously extracted along with time.

The operating mode determining unit 606 determines whether to suppress a noise signal based on the result of determination made by the persistence determining unit 605.

Specifically, the operating mode determining unit 606 switches the operating mode to the normal mode or to the special signal suppression mode based on the persistence determination result.

If the operating mode determining unit 606 selects the special signal suppression mode and determines to suppress a noise signal, the noise-signal suppressing unit 607 removes a special noise signal from the frequency signals in the frequency domain output from the time/frequency converting unit 602. The noise-signal suppressing unit 607 outputs the frequency signal having been subjected to the noise suppression to the frequency/time converting unit 608.

The frequency/time converting unit 608 converts the frequency signal received from the noise-signal suppressing unit 607 into a sound signal in the time domain. The frequency/time converting unit 608 outputs the converted sound signal to the output unit 609.

The output unit 609 performs voice coding on the voice signal received from the frequency/time converting unit 608 as needed and outputs the voice signal to the outside. The output unit 609 may be a wireless transmission unit that wirelessly transmits the received voice signal to the outside.

Figure 21:
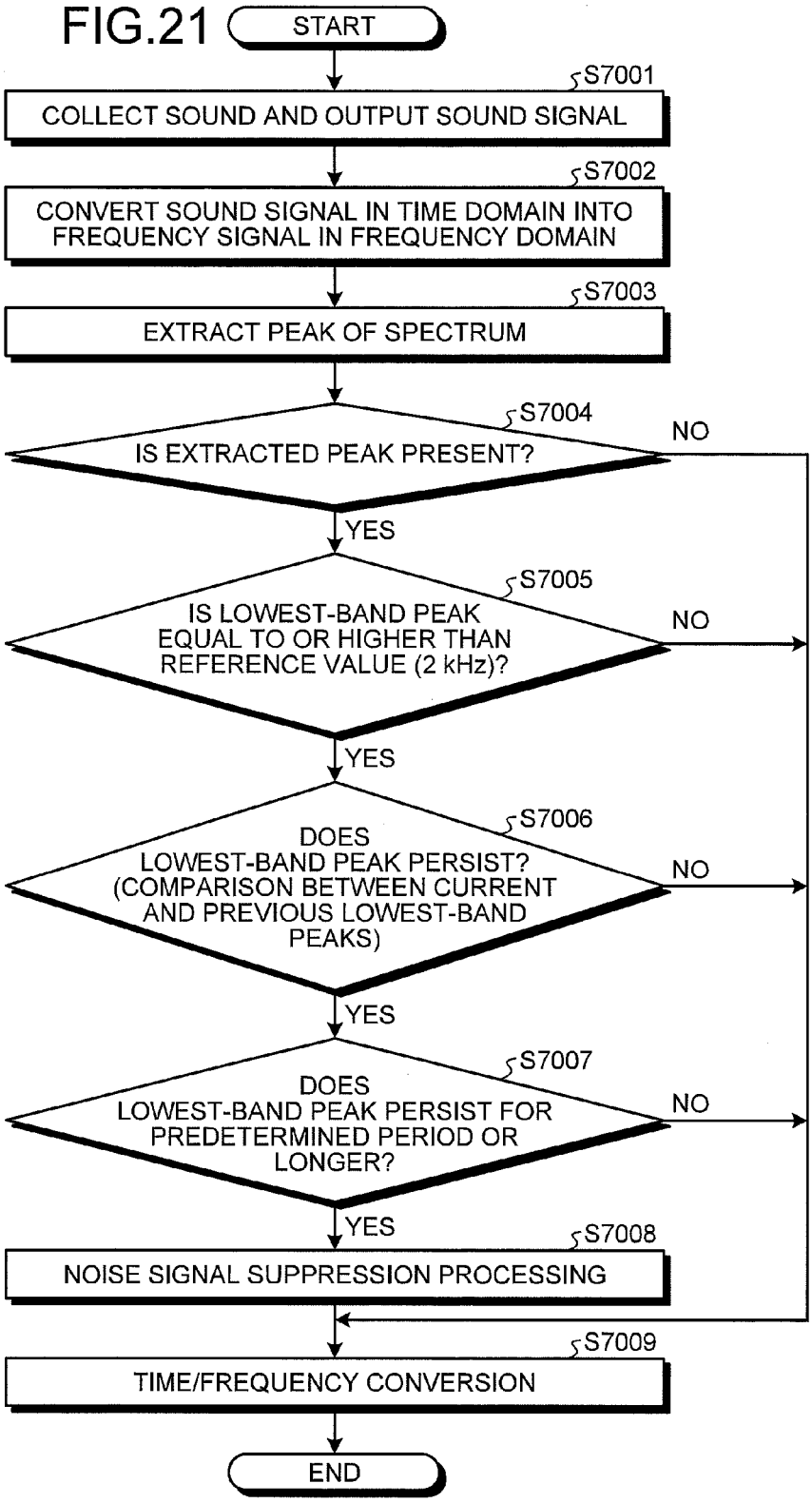
FIG. 21 is a flowchart of an operation of the noise-signal suppressing device according to the fourth embodiment.

The following describes an operation of the noise-signal suppressing device 600. FIG. 21 is a flowchart of an operation of the noise-signal suppressing device 600.

Voice collected by the sound collecting unit 601 is transmitted to the time/frequency converting unit 602 as a sound signal in the time domain (Step S7001). The time/frequency converting unit 602 converts the received sound signal in the time domain into a frequency signal in the frequency domain (Step S7002). The frequency conversion and the inverse frequency conversion are performed in units of sample groups formed in predetermined duration. The frequency resolution is determined based on a sampling rate of the input signal and the number of samples of the frequency converting unit.

The peak extracting unit 603 calculates the average value of all the spectra received from the time/frequency converting unit 602. The peak extracting unit 603 compares the average value of all the calculated spectra with the energy of each spectrum. Thus, the peak extracting unit 603 determines whether a target spectrum has a higher energy ratio with respect to the energy of spectra adjacent thereto (energy of an average spectrum), that is, whether the spectrum has peak characteristics, thereby extracting a peak of the spectrum (Step S7003). The reference for determination of the presence of the peak characteristics may be defined as a spectrum having energy higher than the average energy by 12 dB or more as described above.

The lowest-band peak frequency analyzing unit 604 determines whether a spectrum having peak characteristics is extracted from all the frequency spectra (Step S7004). If the determination result indicates that no extracted peak is present, that is, no notification sound is present or a notification sound having a sufficiently low energy component is present, the lowest-band peak frequency analyzing unit 604 determines that no notification sound is present, and the processing ends. By contrast, if an extracted peak is present, the lowest-band peak frequency analyzing unit 604 determines whether the lowest-band peak spectrum out of the extracted peak spectra is equal to or higher than a reference value of 2 kHz (Step S7005).

The notification sound is an artificial signal and is distributed at a high band. In the case of a digital signal whose band falls within 0 to 4000 Hz which is used in typical speech processing, the notification sound is distributed in a band of equal to or higher than 2 kHz including no harmonic component. As illustrated in FIG. 19, the notification sound has a belt-like frequency distribution in which the frequency is not constant and quickly changes.

To detect such a specific notification sound, it is determined whether there is a frequency component continuously having peak characteristic at a high band and having no component serving as a fundamental frequency at a low band. Thus, the lowest-band peak frequency analyzing unit 604 determines whether the lowest-band peak spectrum is equal to or higher than 2 kHz to detect a notification sound.

If the result of determination made at Step S7005 indicates that a lowest-band peak spectrum having a frequency of equal to or higher than 2 kHz is present, it is determined whether the lowest-band peak spectrum persists (Step S7006). Specifically, if a predetermined bandwidth centered at the lowest-band peak spectrum contains the lowest-band peak spectrum obtained by subsequent frequency conversion, the persistence determining unit 605 determines that the lowest-band peak spectrum persists. Thus, the persistence determining unit 605 can determine whether a peak spectrum of equal to or higher than 2 kHz having no harmonic component is continuously extracted by comparing the peak spectrum with peak spectral information obtained in the previous frequency conversion.

The operating mode determining unit 606 determines whether the lowest-band peak spectrum determined to be equal to or higher than the predetermined frequency by the lowest-band peak frequency analyzing unit 604 persists for a predetermined period or longer (Step S7007). If the determination result indicates that the lowest-band peak spectrum persists, the operating mode determining unit 606 determines to cause the noise-signal suppressing unit 607 to suppress the noise signal. Based on the determination made by the operating mode determining unit 606, the noise signal is suppressed (Step S7008). Subsequently, the frequency/time converting unit 608 performs inverse conversion, thereby generating a voice signal (Step S7009). The generated voice signal is output from the output unit 609.

This configuration can appropriately suppress the notification sound having intense power as a special noise signal. While the explanation has been made of the suppression processing of a special noise signal alone, it is possible to introduce the suppressing device of a special noise signal into a device that suppresses a noise signal in the frequency domain as typified by the conventional spectral subtraction method. This combination can provide a special-noise-signal suppressing device also having the conventional noise-signal suppression effects. This makes it possible to provide a noise suppressing device that can reduce ambient noise together with a notification sound. The notification sound suppressing device may use a frequency conversion method as typified by fast Fourier transform (FFT) and discrete cosine transform (DCT) as in the present embodiment. Alternatively, the notification sound suppressing device may use a frequency division method with a multistage filter structure, such as a finite impulse response (FIR) filter and an infinite impulse response (IIR) filter.

In the description above, the noise-signal suppressing unit 607 performs the suppression processing using the peak spectrum signal extracted by the peak extracting unit 603 in the same manner as in the embodiments above. The present embodiment is not limited thereto, and a peak spectrum determining unit 610 may be provided as illustrated in FIG. 22.

Figure 22:
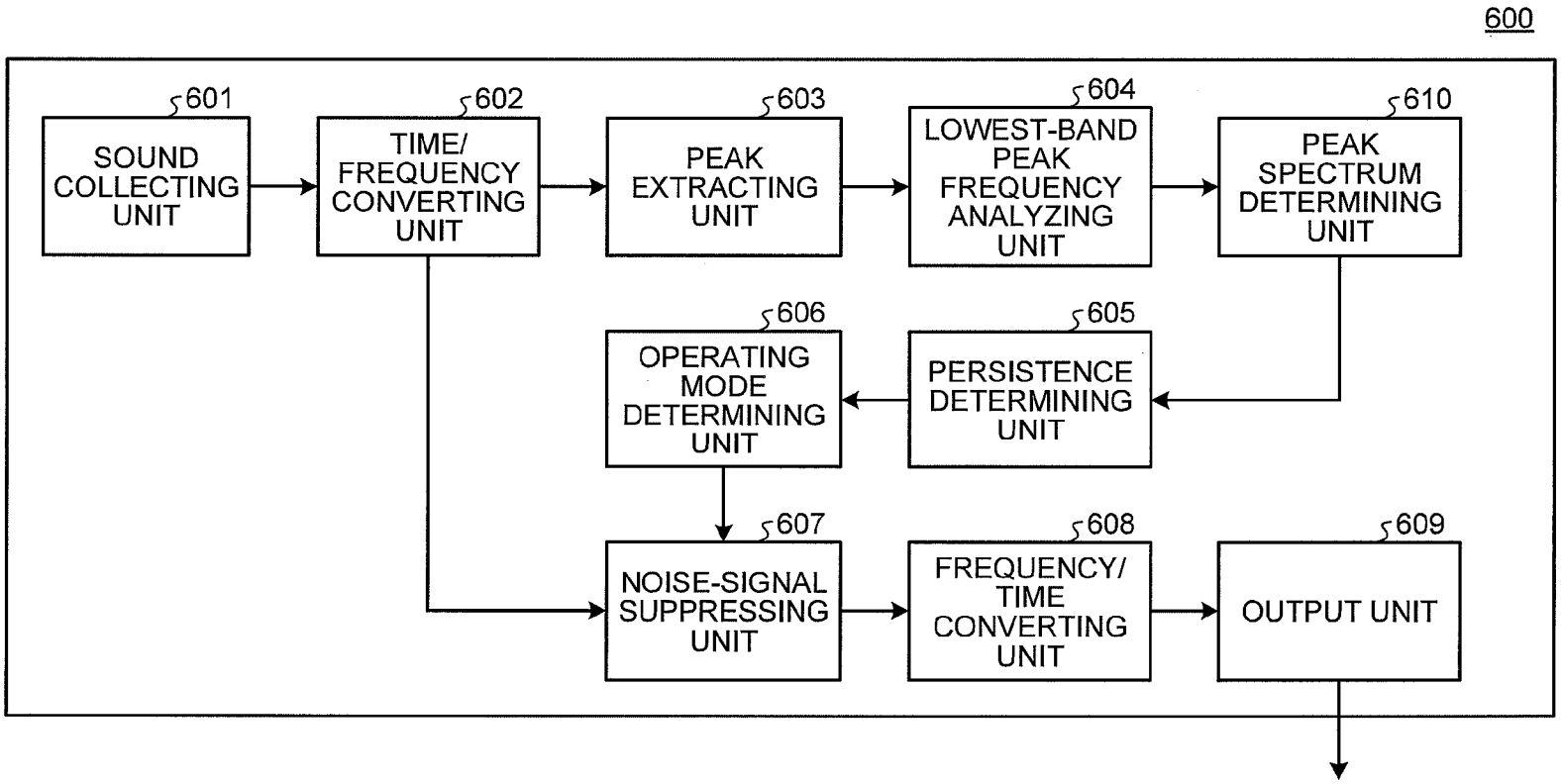
FIG. 22 is a block diagram of the configuration of the noise-signal suppressing device according to a modification of the fourth embodiment.

In FIG. 22, the peak spectrum determining unit 610 registers the lowest-band frequency and the highest-band frequency of the peak spectrum extracted by the peak extracting unit 603. More specifically, the peak spectrum determining unit 610 registers the frequency of the lowest-band peak spectrum determined to be equal to or higher than 2 kHz by the lowest-band peak frequency analyzing unit 604 as the lowest-band frequency, and registers the frequency of the highest-band peak spectrum as the highest-band frequency.

When suppressing noise based on the determination made by the operating mode determining unit 606, the noise-signal suppressing unit 607 suppresses all the spectra in the band between the lowest-band frequency and the highest-band frequency registered by the peak spectrum determining unit 610 as a noise signal.

Because the notification sound to be suppressed has a frequency that quickly changes as illustrated in the spectrogram chart in FIG. 19, the suppression processing is performed more effectively in a wide band than in units of spectra. Because most of the components of a speech signal are present below 2 kHz, the suppression processing affects essential components of the speech in a limited way. Thus, the band to be suppressed is set to all the spectra in the band between the lowest-band peak spectrum and the highest-band peak spectrum based on the extraction result of the peak spectrum. Limiting the band to be suppressed to the band having an intense spectrum can minimize the influence on the speech. In the case of the notification sound illustrated in FIG. 19, for example, the suppression effect is exerted not on an entire band of 2 kHz but on the band between the upper limit and the lower limit of the thick stripe patterns. This allows a word, such as a consonant, having energy components distributed unevenly in a high band in the speech signal to be only partially damaged, thereby making the speech quality more likely to be maintained.

A sound having the lowest-band peak frequency of 2 kHz is assumed to be a sound having no harmonic structure (an artificial notification sound). By detecting that such an artificial intense high-frequency component persists, it is possible to suppress the entire high-frequency component.

Figure 23:
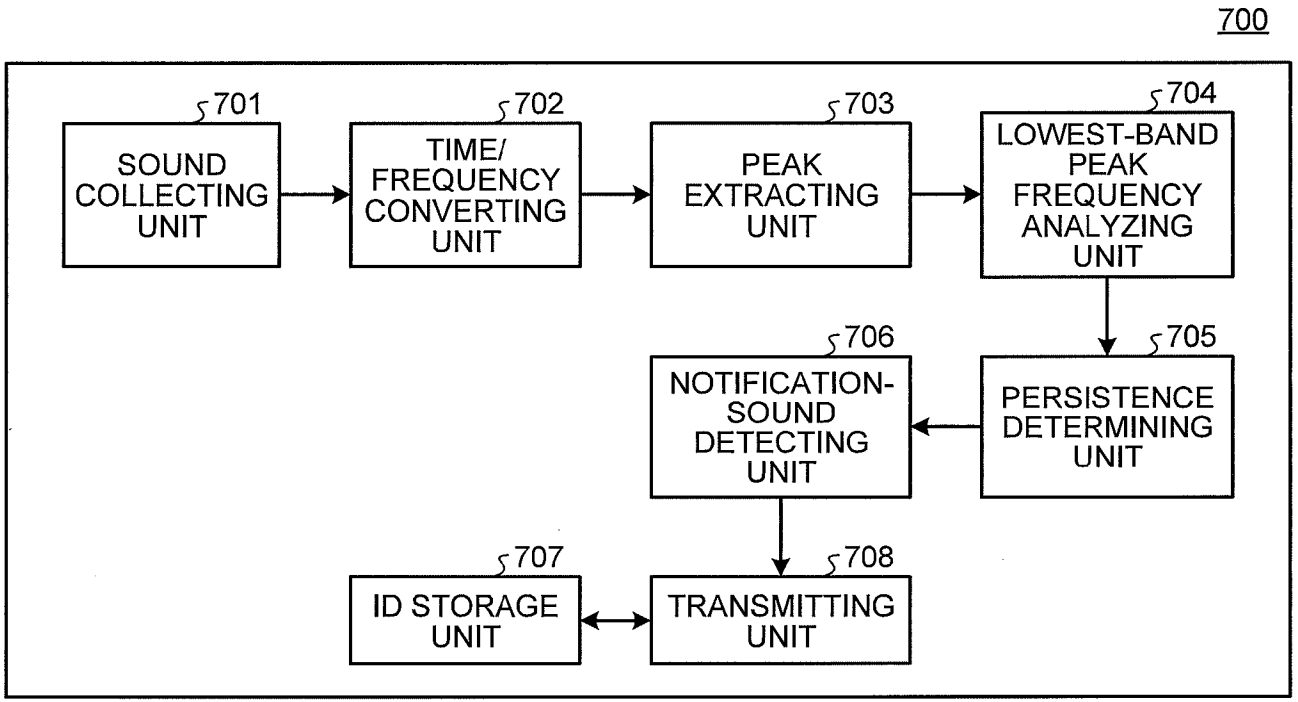
FIG. 23 is a block diagram of the configuration of a notification sound detecting device according to the fourth embodiment.

While the explanation has been made of the noise-signal suppressing device, principles similar to those described above are also applicable to a device for detecting a notification sound (notification-sound detecting device). FIG. 23 is a block diagram of the configuration of a notification-sound detecting device 700. The notification-sound detecting device 700 includes a sound collecting unit 701, a time/frequency converting unit 702, a peak extracting unit 703, a lowest-band peak frequency analyzing unit 704, a persistence determining unit 705, and a notification-sound detecting unit 706. Because units from the sound collecting unit 701 to the persistence determining unit 705 are substantially identical to the units from the sound collecting unit 601 to the persistence determining unit 605 respectively illustrated in FIG. 20, an explanation thereof will be partially omitted.

The lowest-band peak frequency analyzing unit 704 determines whether the lowest-band peak spectrum out of the peak spectra extracted by the peak extracting unit 703 is equal to or higher than a predetermined frequency. The predetermined frequency is preferably set to 2 kHz or a value approximate thereto.

The persistence determining unit 705 determines whether the lowest-band peak spectrum, determined to be equal to or higher than the predetermined frequency by the lowest-band peak frequency analyzing unit 704, persists. If a predetermined bandwidth centered at the lowest-band peak spectrum determined to be equal to or higher than the predetermined frequency (2 kHz in the present embodiment) by the lowest-band peak frequency analyzing unit 704 contains the lowest-band peak spectrum obtained by subsequent frequency conversion, the persistence determining unit 705 determines that the lowest-band peak spectrum persists.

The persistence determining unit 705 does not necessarily determine that the lowest-band peak spectrum persists when the predetermined bandwidth centered at the lowest-band peak spectrum determined to be equal to or higher than the predetermined frequency by the lowest-band peak frequency analyzing unit 704 contains the lowest-band peak spectrum obtained by the subsequent frequency conversion. Alternatively, the persistence determining unit 705 may determine that the lowest-band peak spectrum persists when the lowest-band peak spectrum obtained by the subsequent frequency conversion is present at a band of equal to or higher than the predetermined frequency.

If the lowest-band peak spectrum determined to be equal to or higher than the predetermined frequency by the lowest-band peak frequency analyzing unit 704 persists for a predetermined period or longer, the notification-sound detecting unit 706 determines that the lowest-band peak spectrum is caused by a notification sound and detects the notification sound. If the notification-sound detecting unit 706 detects the notification sound, the notification-sound detecting unit 706 outputs notification sound detection information indicating that the notification sound is detected to a transmitting unit 708.

The notification-sound detecting device 700 further includes an identification (ID) storage unit 707 and the transmitting unit 708. The ID storage unit 707 stores therein an ID that identifies a device or a user. The transmitting unit 708 transmits, when a notification sound is detected by the notification-sound detecting unit 706, the ID and the notification sound detection information indicating that the notification sound is detected to the outside.

Figure 24:
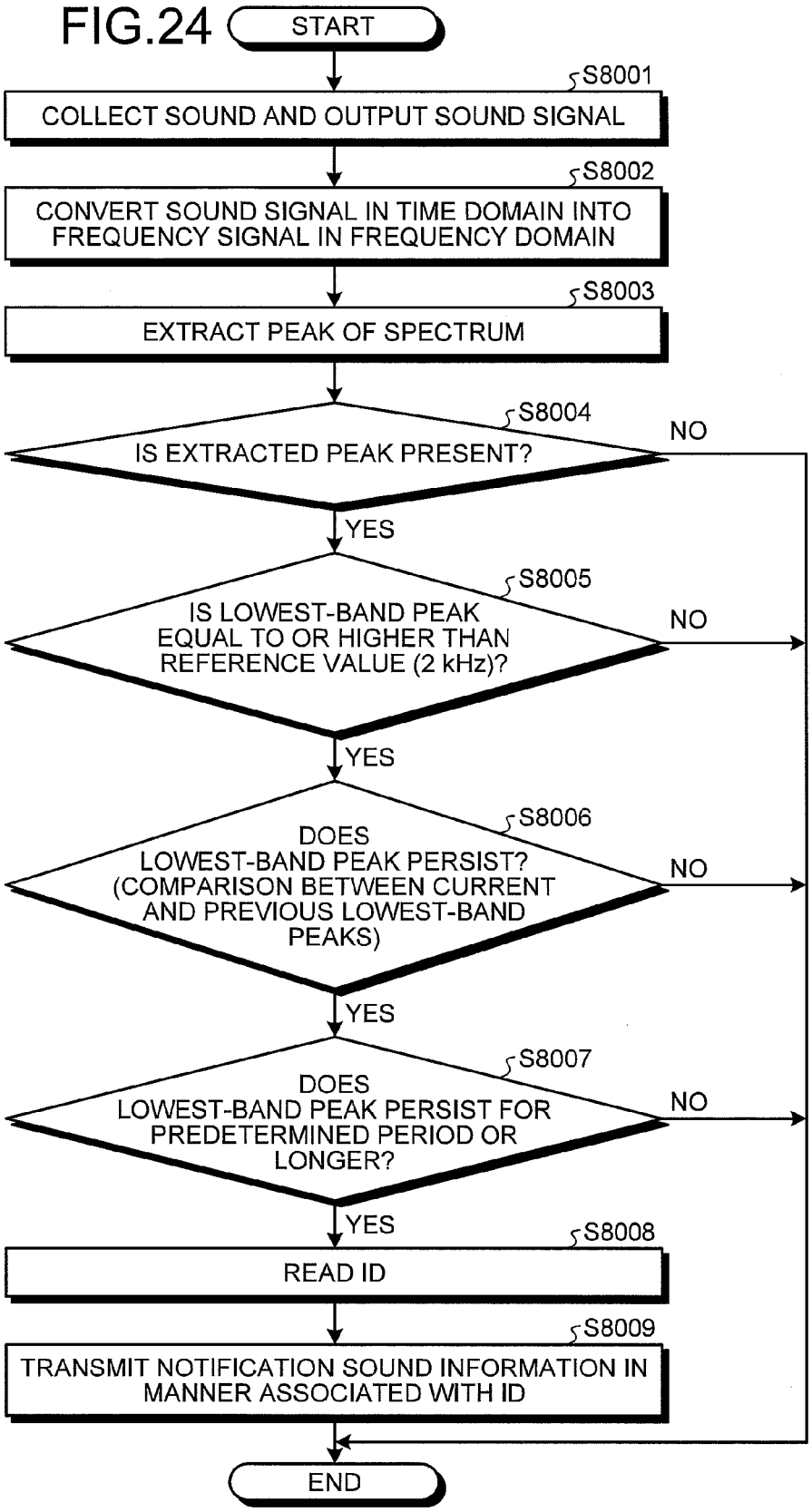
FIG. 24 is a flowchart of an operation of the notification-sound detecting device according to the fourth embodiment.

FIG. 24 is a flowchart of an operation of the notification-sound detecting device 700. Because processing at Step S8001 to Step S8006 is substantially the same as the processing at Step S7001 to Step S7006 described with reference to FIG. 21, an explanation thereof will be omitted.

Based on the result of determination made by the persistence determining unit 705 at Step S8006, the notification-sound detecting unit 706 determines whether the lowest-band peak spectrum determined to be equal to or higher than the predetermined frequency by the lowest-band peak frequency analyzing unit 704 persists for the predetermined period or longer (Step S8007). If the lowest-band peak spectrum persists for the predetermined period or longer, the notification-sound detecting unit 706 determines that a notification sound is ringing and reads an ID serving as identification information uniquely identifying a terminal (a device) or a user from the ID storage unit 707 (Step S8008).

The transmitting unit 708 transmits notification sound detection information indicating that the notification sound is detected to the outside in a manner associated with the read ID (Step S8009).

In the case in which an ID is added to speech information when speech is transmitted and the notification sound detection information is transmitted together with the speech information, the ID is not necessarily read again to be transmitted to the outside. In this case, the system control may skip Step S8008 and, if it is determined that the lowest-band peak spectrum persists for the predetermined period or longer at Step S8007, go to Step S8009. When the speech information is transmitted to the destination of the speech, for example, the ID is not necessarily added to the speech information. The ID may be an identification number allocated to each communication device.

The notification-sound detecting unit 706 may determine the type of the detected notification sound. The transmitting unit 708 may transmit the type of the notification sound determined by the notification-sound detecting unit 706 in a manner associated with the ID.

The notification sound caused by a spectrum of equal to or higher than 2 kHz detected by the notification-sound detecting unit 706 is used for a life-support system, for example. The notification-sound detecting device 700 determines that the life-support system is operating and transmits the fact together with the ID associated with the terminal to a communication partner, thereby enabling a third party to take an appropriate response. The notification sound detection information may be transmitted to a destination determined in advance.

Fifth Embodiment

A noise-signal suppressing device according to a fifth embodiment switches the operating modes by increasing and decreasing the persistence point similarly to the noise-signal suppressing device according to the third embodiment. The noise-signal suppressing device and a notification-sound detecting device according to the fifth embodiment are described with reference to the block diagrams in FIG. 22 and FIG. 23.

In the noise-signal suppressing device and the notification-sound detecting device according to the fifth embodiment, a persistence determining unit 605 and a persistence determining unit 705 further manage a set value to increase when each of the lowest-band peak spectra is determined to persist, and to decrease when each of the lowest-band peak spectra is determined not to persist. The noise-signal suppressing device 600 switches the operating modes based on whether the set value exceeds a predetermined threshold.

In the notification-sound detecting device 700, a notification-sound detecting unit 706 detects a notification sound when the set value exceeds a predetermined threshold. If a peak extracting unit 703 detects no peak spectrum or if a lowest-band peak frequency analyzing unit 704 determines that the lowest-band peak spectrum is not equal to or higher than a predetermined frequency, the persistence determining unit 705 decreases the set value.

Figure 25:
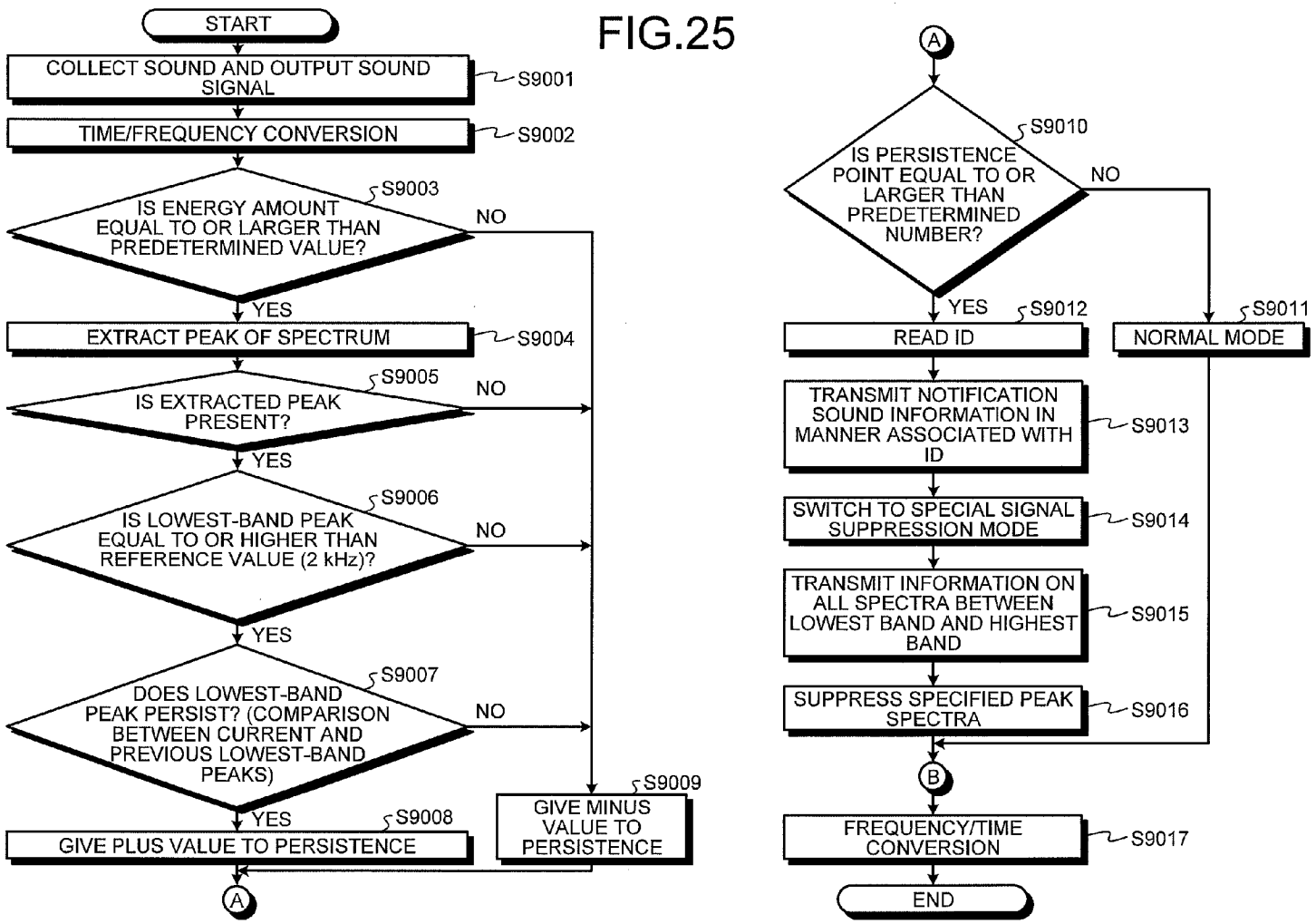
FIG. 25 is a flowchart of an operation of a noise-signal suppressing device according to a fifth embodiment.
Figure 26:
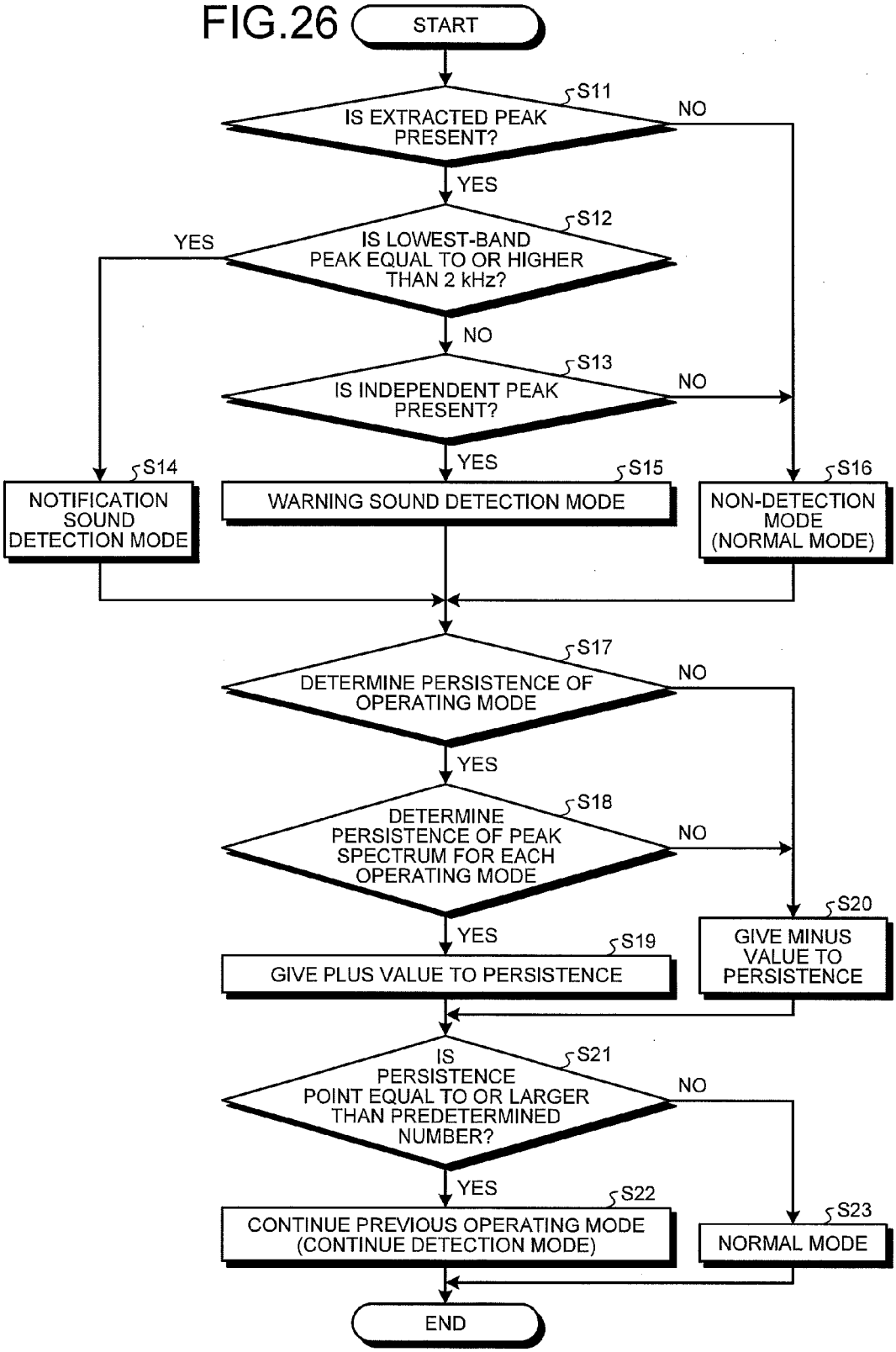
FIG. 26 is a flowchart of an operation of a notification-sound detecting device according to the embodiment.

FIG. 25 is a flowchart of an operation of the noise-signal suppressing device according to the fifth embodiment. A sound collecting unit 601 collects speech and outputs a sound signal in the time domain (Step S9001). A time/frequency converting unit 602 converts the input sound signal into a frequency signal in the frequency domain (Step S9002).

A peak extracting unit 603 calculates an energy amount (a sound pressure level) of a sample group formed of a plurality of samples serving as a unit of processing and determines whether the energy amount exceeds a predetermined energy amount (Step S9003). This processing is performed to determine whether a target sound signal in a voice coding process is affected by noise based on the energy of the input signal. Special noise included in the input signal, that is, a noise signal of a notification sound having a low sound pressure level slightly affects the sound signal in the voice coding, and a sufficient speech quality is maintained. Thus, the suppression processing simply needs to be performed only when an excessively large notification sound is present. The peak extracting unit 603 determines whether the sound pressure level of the input signal is equal to or higher than 80 dB. If the sound pressure level is equal to or higher than 80 dB, suppression processing of the special noise signal is performed (no suppression processing may possibly be performed in the end). If the sound pressure level is lower than 80 dB, a minus value is given to the persistence point serving as the set value relating to the determination of persistence for determining whether to perform the suppression processing on the special noise component (Step S9009). The calculation of the energy amount may be made either before or after the frequency conversion.

The peak extracting unit 603 extracts a peak spectrum (Step S9004). The peak extracting unit 603 determines whether a peak spectrum extracted at Step S9004 is present (Step S9005). If no peak spectrum is present (No at Step S9005), a minus value is given to the persistence point (Step S9009). By contrast, if a peak spectrum is present (Yes at Step S9005), the lowest-band peak frequency analyzing unit 704 determines whether the lowest-band peak spectrum out of the extracted peak spectra is equal to or higher than 2 kHz, which is a reference value (Step S9006). If the determination result indicates that the lowest-band peak spectrum is equal to or lower than 2 kHz, a minus value is given to the persistence point (Step S9009). By contrast, if the lowest-band peak spectrum is equal to or higher than 2 kHz, a comparison is made between the current and previous lowest-band peak spectra, thereby determining whether the peak spectrum persists (Step S9007). If the peak spectrum does not persist, a minus value is given to the persistence point (Step S9009). By contrast, if the peak spectrum persists, a plus value is given to the persistence point (Step S9008). An operating mode determining unit 606 determines whether the persistence point is equal to or larger than a predetermined threshold (Step S9010). If the persistence point is equal to or smaller than the predetermined threshold, the operating mode determining unit 606 switches the operating mode to the normal mode to perform no noise suppression processing (Step S9011). By contrast, if the persistence point is equal to or larger than the predetermined threshold, it is determined that a notification sound is ringing and an ID is read from an ID storage unit 707 (Step S9012). Notification sound information indicating that the notification sound is detected is transmitted to the outside in a manner associated with the ID (Step S9013). The operating mode determining unit 606 switches the operating mode to the special signal suppression mode (Step S9014). Spectral information on the spectra between the lowest-band frequency and the highest-band frequency registered by a peak spectrum determining unit 610 is transmitted to a noise-signal suppressing unit 607 (Step S9015). The noise-signal suppressing unit 607 determines the range described above to be the specified spectra to perform noise suppression processing (Step S9016). Finally, frequency/time conversion is performed, and a sound signal is output (Step S9017). Thus, the noise-signal suppressing device 600 and the notification-sound detecting device 700 can suppress the notification sound to improve the speech quality and can notify the recipient of the sound signal of the presence of the notification sound. This enables transmission of both the voice signal and emergency information (presence of the notification sound), which are required information.

The following describes a noise-signal suppressing device that combines the determination processing based on the lowest-band peak and the determination processing based on the independence. The device suppresses a noise signal by switching three operating modes. The device performs the determination processing based on the lowest-band peak to detect a notification sound and performs the determination processing based on the independence mainly to detect a warning sound.

Examples of the notification sound include a notification sound composed of high-frequency components (personal alert safety system (PASS) alarms) and PASS alarms used for a life-support diagnosis and notification of a residual amount of an oxygen cylinder. Examples of the warning sound include an artificial tone signal composed of harmonic components such as a siren sound and a high-pitched engine sound, which are long periodic noise.

It is determined whether an extracted peak is present (Step S11). If no peak is extracted, the operating mode is set to a normal mode (Step S16). By contrast, if a peak is extracted, it is determined whether the lowest-band peak spectrum out of the extracted peaks is equal to or higher than 2 kHz (Step S12). If the lowest-band peak spectrum is equal to or higher than 2 kHz, the operating mode is switched to a notification sound detection mode (Step S14). By contrast, if the lowest-band peak spectrum is equal to or lower than 2 kHz, it is determined whether an independent peak spectrum is present (Step S13). If an independent peak spectrum is present, the operating mode is switched to a warning sound detection mode (Step S15). By contrast, if no independent peak spectrum is present, the operating mode is switched to the normal mode (Step S16).

After the determination processing is performed and any one of the operating modes is set, the persistence of the operating mode is determined by determining whether the set operating mode is the same as that in the current frame (Step S17). If each of the operating modes does not persist, a minus value is given to the persistence point (Step S20). By contrast, if each of the operating modes persists, the persistence of a peak spectrum is determined for each of the operating modes (Step S18). If a peak spectrum persists in each of the operating modes, a plus value is given to the persistence point (Step S19). If no peak spectrum persists, a minus value is given to the persistence point (Step S20).

It is determined whether the persistence point is equal to or larger than a predetermined number (Step S21). If the determination result indicates that the persistence point is equal to or smaller than the predetermined value, the operating mode is switched to the normal mode (Step S23). If the persistence point is equal to or larger than the predetermined value, the previous operating mode, which is a detection mode used in the previous processing block, continues (Step S22).

As described above, the notification-sound detecting device (special-signal detecting device) that detects both a notification sound and a warning sound includes a peak independence determining unit at the subsequent stage of a lowest-band peak frequency analyzing unit. If the lowest-band peak frequency analyzing unit determines that the lowest-band peak spectrum out of the peak spectra extracted by a peak extracting unit is not equal to or higher than the predetermined frequency, the peak independence determining unit determines whether the extracted peak spectrum maintains a frequency interval of equal to or larger than a predetermined value with respect to a peak spectrum adjacent thereto. A persistence determining unit makes a second determination for determining whether the peak spectrum persists, which the peak spectrum is determined to maintain a frequency interval of equal to or larger than the predetermined value with respect to the peak spectrum adjacent thereto by the peak independence determining unit. Based on the result of the second determination made by the persistence determining unit, a notification-sound detecting unit detects a warning sound. With this configuration, the notification-sound detecting device can preferentially detect a notification sound and also detect a warning sound having a peak spectrum in a low-frequency range compared with the notification sound.

As described in the embodiments above, the present embodiments consider that noise reduction processing needed for mobile communications requires various elements, such as a low-delay signal analysis, immediate responsiveness (instantaneous effectiveness of noise reduction effects), reduction performance of noise including ambient noise, and low power consumption, and provides methods for satisfying these requirements. A conventional method for detecting and suppressing a warning sound, such as a siren sound, of a special signal needs to carry out a harmonic analysis and a pattern analysis with a reference buffer to derive a fundamental frequency of the warning sound and detect the special noise signal. The conventional method requires a processing time for the analysis. To carry out a harmonic analysis, determination of harmonics, and a pattern analysis, complicated signal processing is required, resulting in reduction in the convenience and an increased circuit scale. Furthermore, it is necessary to consider an influence of components, such as speech and an ambient noise signal, other than the warning sound to be suppressed. The present embodiments appropriately address the disadvantages described above.

If a siren sound, a notification sound, an engine sound, and the like at an extremely high sound pressure level are mixed in coding of a sound signal, the coding quality of the sound signal deteriorates significantly. This is because while the highly efficient coding can be performed by the modeling of vibrations of a vocal tract, which is a characteristic of speech, it is difficult to distinguish a tone signal from a speech signal. Because a speech signal and a noise signal are hard to be distinguished, a certain amount of information is allocated to the noise signal, thereby deteriorating the speech quality. To detect the special signal, the conventional method requires an analysis time of several seconds and complicated signal processing, such as a harmonic analysis and a pattern analysis with a reference buffer, resulting in reduction in the convenience. Because it is difficult to distinguish the special signal from a speech signal, mixture of a speech signal deteriorates the detection performance for the special signal. This causes the speech signal to be erroneously detected as the special signal, thereby removing the speech signal (erroneously suppressing the speech).

In the voice coding method, protecting frequency components near a fundamental frequency, which are major components, may possibly restore a high-band component in the process of coding and decoding. By suppressing several intense noise spectra present in a mid-high-band (approximately equal to or higher than 400 Hz), which are non-major components, it is possible to significantly improve the voice coding quality. Even if a special noise (e.g., a siren sound) can be suppressed not completely but to some extent with a simple way, the suppression effects are sufficiently exerted depending on uses (e.g., a communication device employing a low-rate voice coding method).

An aspect of the embodiments converts a speech input signal into a frequency domain signal and then extracts an independent spectrum having extremely high energy compared with the whole sound volume and spectra in an adjacent frequency band. This eliminates the possibility of erroneous extraction of a speech signal spectrum as a peak spectrum to be removed. By excluding spectrum signals of 100 to 400 Hz, which is a fundamental frequency of speech, in terms of independence (proximity of peak spectra), the aspect can distinguish a speech signal from a special signal (a tone signal of approximately equal to or higher than 400 Hz). This makes it possible to extract special spectra (high-band components) to some extent with no determination of harmonics or no pattern analysis (even if some of the special spectra are left, a serious influence thereof on speech coding is reduced).

An aspect of the embodiments limits a spectrum focused on as a special noise signal to the lowest-band peak spectrum out of the peak spectra, thereby reducing the processing load of persistence determination for determining the persistence. Only one point of the frequency needs to be focused on. The aspect sets a predetermined threshold for a persistence counting number and observes the persistence in a long term. Thus, even if the lowest-band peak spectrum moves because of some causes (e.g., mixture of speech), mixture of a special noise signal occurs only in a short time or spectra not to be detected are limited to low-band spectra (high-band spectra are determined to be special noise, and are detected and reduced).

An aspect of the embodiments observes the persistence of a peak spectrum signal including no speech signal. Thus, the aspect can quickly switch to the suppression operating mode to suppress an excessively large specific signal that hinders voice coding by detecting the persistence in a predetermined time (one second or shorter is sufficient) with no analysis of a harmonic structure or no pattern analysis of a special signal having a long periodicity (the analysis usually takes approximately five seconds, that is, at least a time of one pattern in the case of a siren sound). The aspect observes the persistence by giving a plus value when the persistence of the lowest-band peak spectrum is detected and giving a minus value when no persistence thereof is detected. The aspect observes the persistence while avoiding an influence of a speech signal (exclusion of a non-independent peak spectrum not clearly distinguished from the speech signal). By expanding the observation range (approximately 50 to 100 Hz, which depends on frequency resolving duration) to a predetermined bandwidth centered at the lowest-band peak spectrum, the aspect can follow special noise whose frequency changes.

An aspect of the embodiments detects the presence of an intense frequency component in a band exceeding 2 kHz in 8-kHz sampling (whose effective band is 0 to 4 kHz) typically used in digitalization of a speech signal and then detects the persistence of the frequency component, thereby determining that an artificial notification sound is likely to be input. Thus, the aspect switches to the suppression operating mode. Because a peak is present in a band of equal to or higher than 2 kHz, it is assumed that the detected peak is not a peak corresponding to harmonics but a fundamental frequency of a special signal (artificial notification sound). By detecting the presence of a peak at 2 kHz and observing the persistence thereof, the aspect can determine whether a notification sound is present with no harmonic analysis, no pattern analysis, or no determination of harmonics. The aspect estimates the distribution of an intense high-band component that hinders speech coding from the lower limit and the upper limit of the extracted peak and suppresses the entire frequency between the lower limit and the upper limit. While the suppression of the high-band components in a wide range changes the sound quality, the aspect can effectively maintain mid-low band components, which are essential elements of speech to achieve mutual understanding.

While the threshold used to detect the lowest-band peak spectrum is set to 2 kHz in the description above, the present embodiment is not limited thereto. The threshold may be set to a frequency lower than the notification sound and higher than the speech. The lowest-band peak frequency analyzing unit determines whether the lowest-band peak spectrum out of a plurality of peak spectra extracted by the peak extracting unit at the previous stage has a frequency higher than the threshold.

Obviously, the first to the fifth embodiments may be combined. The device and the method for suppressing a noise signal, the device and the method for detecting a special signal, and the device and the method for detecting a notification sound according to the embodiments are applicable to communication devices or external microphones of the communication devices, for example.

The present invention is not limited to the embodiments above, and various changes may be made without departing from the spirit and scope of the invention. The processing described above may be performed by a computer program stored in a read only memory (ROM) of a main processor, for example. In the embodiments above, the computer program including an instruction group that causes a computer (processor) to perform the processing may be stored in various types of a non-transitory computer-readable medium and supplied to the computer. The non-transitory computer-readable medium includes various types of a tangible storage medium. Examples of the non-transitory computer-readable medium include a magnetic recording medium (e.g., a flexible disk, a magnetic tape, and a hard disk drive), a magneto-optical recording medium (e.g., a magneto-optical disc), a compact disc read only memory (CD-ROM), a compact disc recordable (CD-R), a compact disc recordable/rewritable (CD-R/W), and a semiconductor memory (e.g., a mask ROM, a programmable ROM (PROM), an erasable PROM (EPROM), a flash ROM, and a random access memory (RAM)). The computer program may be stored in various types of a transitory computer-readable medium and supplied to the computer. Examples of the transitory computer-readable medium include an electrical signal, an optical signal, and an electromagnetic wave. The transitory computer-readable medium can supply the computer program to the computer via a wired communication path, such as an electric wire and an optical fiber, or a wireless communication path.

According to the embodiments, provided is a device and method for detecting a special signal that detect the presence of a special signal in a short time with a smaller amount of memory and operation without being restricted by the type of a warning sound and use conditions. Further, provided is the device and method for suppressing a noise signal according to the embodiments that estimates the presence of a special noise signal in a short time with a smaller amount of memory and operation without being restricted by the type of a warning sound and use conditions, and suppresses a noise signal component.

Provided is a device and a method for detecting a notification sound that detects the presence of a notification sound in a short time with a smaller amount of memory and operation without being restricted by the type of the notification sound and use conditions. The device and method for suppressing a noise signal according to the embodiments estimates the presence of a notification sound in a short time with a smaller amount of memory and operation without being restricted by the type of a notification sound and use conditions, and suppresses a noise signal component.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A noise signal suppressing device comprising:

a sensor configured to capture a sound signal; and a processor, wherein the processor is configured to:

convert the sound signal captured by the sensor in a time domain into a frequency signal in a frequency domain;

extract first peaks having higher energy than that of an adjacent frequency region from the frequency signal in the frequency domain;

identify one or more of the first peaks as one or more second peaks, each of the one or more second peaks maintain a frequency interval of equal to or larger than a predetermined value with respect to the first peaks adjacent thereto;

identify at least one of the second peaks that is located at a lowest frequency as a third peak, and determine whether the third peak persisting for a predetermined period or longer exists in a predetermined bandwidth centered at the third peak; and suppress the third peak as a noise signal when the third peak persists in the predetermined bandwidth for the predetermined period or longer.

2. The noise signal suppressing device according to claim 1, wherein the processor increases a set value, when the third peak persisting for the predetermined period or longer exists in the predetermined bandwidth, and wherein the processor decreases the set value when the third peak persisting for the predetermined period or longer does not exist in the predetermined bandwidth, and wherein the processor determines whether or not to suppress the noise signal based on whether or not the set value exceeds a predetermined threshold.

3. A noise signal suppressing method comprising:

converting an input sound signal in a time domain into a frequency signal in a frequency domain;

extracting first peaks having higher energy than that of an adjacent frequency region from the frequency signal in the frequency domain;

identifying one or more of the first peaks as one or more second peaks, each of the one or more second peaks maintain a frequency interval of equal to or larger than a predetermined value with respect to the first peaks adjacent thereto;

identifying at least one of the second peaks that is located at a lowest frequency as a third peak, and determining whether the third peak persisting for a predetermined period or longer exists in a predetermined bandwidth centered at the third peak; and suppressing the third peak as a noise signal when the third peak persists in the predetermined bandwidth for the predetermined period or longer.

4. A notification sound detecting device comprising:

a sensor configured to capture a sound signal; and a processor, wherein the processor is configured to convert the sound signal captured by the sensor in a time domain into a frequency signal in a frequency domain;

extract first peaks having higher energy than that of an adjacent frequency region from the frequency signal;

determine whether a third peak, which is a peak located at a lowest frequency among the first peaks, is located at a frequency equal to or higher than a predetermined frequency;

when the third peak is determined to be located at the frequency equal to or higher than the predetermined frequency, determine whether the third peak persisting for a predetermined period or longer exists in a predetermined bandwidth centered at the third peak;

detect a notification sound when the third peak persisting for the predetermined period or longer is determined to exist in the predetermined bandwidth; and determine that the notification sound is not presented when the third peak persisting for the predetermined period or longer is determined not to exist in the predetermined bandwidth.

5. The notification sound detecting device according to claim 4, wherein the processor increases a set value when the third peak persisting for the predetermined period or longer is determined to exist in the predetermined bandwidth, wherein the processor decreases the set value when the third peak persisting for the predetermined period or longer is determined not to exist in the predetermined bandwidth, and wherein the processor detects the notification sound when the set value exceeds a predetermined threshold.

6. The notification sound detecting device according to claim 5, wherein when no first peak is extracted or when the third peak is not determined to be located at the frequency equal to or higher than the predetermined frequency, the processor decreases the set value.

7. The notification sound detecting device according to claim 5, wherein when the processor determines that the third peak is not located at the frequency equal to or higher than the predetermined frequency, the processor determines whether one or more of the first peaks maintain a frequency interval of equal to or larger than a predetermined value with respect to the first peaks adjacent thereto, wherein, when the processor determines that the one or more of the first peaks maintain the frequency interval of equal to or larger than the predetermined value with respect to the first peaks adjacent thereto, the processor makes a second determination of whether the one or more of the first peaks persisting for a predetermined period or longer exist in a predetermined bandwidth, and wherein the processor detects a warning sound when the processor determines that the one or more of the first peaks persisting for the predetermined period or longer exist in the predetermined bandwidth.

8. A notification sound detecting method comprising:

converting an input sound signal in a time domain into a frequency signal in a frequency domain;

extracting first peaks having higher energy than that of an adjacent frequency region from the frequency signal;

determining whether a third peak, which is a peak located at a lowest frequency among the first peaks, is located at a frequency equal to or higher than a predetermined frequency;

when the third peak is determined to be located at the frequency equal to or higher than the predetermined frequency, determining whether the third peak persisting for a predetermined period or longer exists in a predetermined bandwidth centered at the third peak;

detecting a notification sound when the third peak persisting for the predetermined period or longer is determined to exist in the predetermined bandwidth; and determining that the notification sound is not presented when the third peak persisting for the predetermined period or longer is determined not to exist in the predetermined bandwidth.

9. A noise signal suppressing device comprising:

a sensor configured to capture a sound signal; and a processor, wherein the processor is configured to convert the sound signal captured by the sensor in a time domain into a frequency signal in a frequency domain;

extract first peaks having higher energy than that of an adjacent frequency region from the frequency signal;

determine whether a third peak, which is a peak located at a lowest frequency among the first peaks, is located at a frequency equal to or higher than a predetermined frequency;

when the third peak is determined to be located at the frequency equal to or higher than the predetermined frequency, determine whether the third peak persisting for a predetermined period or longer exists in a predetermined bandwidth centered at the third peak;

determine whether or not to suppress a noise signal based on a result of determination of whether the third peak persisting for the predetermined period or longer exists in the predetermined bandwidth centered at the third peak; and suppress the third peak as the noise signal when the noise signal is determined to be suppressed.

10. The noise signal suppressing device according to claim 9, wherein the processor registers a lowest-band frequency and a highest-band frequency of the first peaks, and wherein the processor suppresses all spectra in a band between the lowest-band frequency and the highest-band frequency as a noise signal.

11. A noise signal suppressing method comprising:

converting an input sound signal in a time domain into a frequency signal in a frequency domain;

extracting first peaks having higher energy than that of an adjacent frequency region from the frequency signal;

determining whether a third peak, which is a peak located at a lowest frequency among the first peaks, is located at a frequency equal to or higher than a predetermined frequency;

when the third peak is determined to be located at the frequency equal to or higher than the predetermined frequency, determining whether the third peak persisting for a predetermined period or longer exists in a predetermined bandwidth centered at the third peak;

determining an operation mode whether or not to suppress a noise signal based on a result of determination of whether the third peak persisting for the predetermined period or longer exists in the predetermined bandwidth centered at the third peak; and suppressing the third peak as the noise signal when the noise signal is determined to be suppressed.

* * * * *